US006179287B1

(12) United States Patent
Watanabe et al.

(10) Patent No.: US 6,179,287 B1
(45) **Date of Patent: *Jan. 30, 2001**

(54) SHEET STACKING APPARATUS WITH STACKING AND RETAINING TRAY

(75) Inventors: Tomoyuki Watanabe, Yokohama; Hiroaki Namiki, Kawasaki, both of (JP)

(73) Assignees: Canon Kabushiki Kaisha; Canon Aptex Kabushiki Kaisha, both of Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/772,095

(22) Filed: Dec. 20, 1996

(30) Foreign Application Priority Data

Dec. 21, 1995 (JP) ..... 7-333542

(51) Int. Cl.[7] ..... B65H 43/04

(52) U.S. Cl. ..... 271/215; 271/184; 271/250; 414/791.2; 270/58.31; 270/52.03

(58) Field of Search ..... 271/184, 250, 271/253, 254; 414/791.2; 270/58.31, 52.03

(56) References Cited

U.S. PATENT DOCUMENTS 4,073,391 * 2/1978 O'Brien et al. ..... 414/791.2 X
4,134,672 * 1/1979 Burlew et al. ..... 414/791.2 X
4,162,786 * 7/1979 Bullock ..... 271/184 X
4,977,432 * 12/1990 Coombs et al. ..... 271/184 X
4,981,293 * 1/1991 Yamashita et al. ..... 414/791.2 X
5,080,345 * 1/1992 Daniels ..... 271/250 X
5,280,331 1/1994 Namiki .
5,407,081 * 4/1995 Oshino et al. ..... 270/58.31
5,540,370 * 7/1996 Ring ..... 271/253 X

FOREIGN PATENT DOCUMENTS 1-313261 12/1989 (JP) .

OTHER PUBLICATIONS

U.S. application No. 08/095,230, Watanabe et al., filed Jul. 23, 1993.*

* cited by examiner

*Primary Examiner*—Christopher P. Ellis
*Assistant Examiner*—Richard Ridley
(74) *Attorney, Agent, or Firm*—Fitzpatrick, Cella, Harper & Scinto

(57) ABSTRACT

A sheet stacking apparatus includes a sheet discharging device for discharging sheets; a stacking tray for stacking sets of the sheets discharged by the sheet discharging device; a retaining tray for retaining one sheet discharging by the discharging device; a shifting device for shifting, in a direction crossing with a direction of the discharging of the sheet, the one sheet on the retaining tray; a feeding device for feeding the one sheet to the stacking tray; whereby the sets of the sheets are grouped with the sheet shifted by the shifting device.

31 Claims, 14 Drawing Sheets

SHEET STACKING APPARATUS WITH STACKING AND RETAINING TRAY

FIELD OF THE INVENTION AND RELATED ART

The present invention relates to a sheet accumulation apparatus, for example, a sheet accumulation apparatus for accumulating cut sheets (hereinafter, "sheet") which are discharged from the main assembly of an image forming apparatus after an image is formed thereon. It also relates to an image forming apparatus such as a copying machine, a printer, or a facsimile, which comprises such a sheet accumulation apparatus. More specifically, the present invention relates to such a sheet accumulation apparatus that accumulates and jogs the discharged sheets to abut them to a reference, with slight displacement of the uppermost or bottom most sheet, and an image forming apparatus comprising such a sheet accumulation apparatus.

In a conventional sheet accumulation apparatus, the sheets are sorted into a set of sheets, and each set is delivered into a different tray as disclosed in Japanese Laid-Open Patent Application No. 313,261/1990.

However, in the conventional sheet accumulation apparatus, trays must be shifted for each set of sheets. Therefore, in order to increases the number of sheet sets or sheets in each set, which can be handled by a conventional sheet accumulation apparatus, the number of trays must be increased, and in addition, a large power source is necessary to move a large number of trays. As a result, apparatus size becomes larger, increasing the apparatus cost and also requiring a larger space for the apparatus.

SUMMARY OF THE INVENTION

The present invention was made in view of the aforementioned shortcomings of a conventional sheet accumulation apparatus, and its object is to provide a sheet accumulation apparatus capable of slightly displacing the topmost or bottommost sheet of each sheet set from the rest in order to make it easier to separate the accumulated sheet sets from each other, and also to provide an image forming apparatus comprising such a sheet accumulation apparatus, since such a sheet accumulation apparatus and an image forming apparatus can eliminate the need for size increase and also can afford cost reduction.

According to an aspect of the present invention, there is provided a sheet stacking apparatus comprising sheet discharging means for discharging sheets; a stacking tray for stacking sets of the sheets discharged by said sheet discharging means; a retaining tray for retaining one sheet discharging by said discharging means; shifting means for shifting, in a direction crossing with a direction of the discharging of the sheet, the one sheet on said retaining tray; feeding means for feeding the one sheet to said stacking tray; whereby the sets of the sheets are grouped with the sheet shifted by said shifting means.

According to another aspect of the present invention, there is provided a sheet stacking apparatus comprising sheet discharging means for discharging sheets; a first tray for stacking the sheets discharged by said discharging means; aligning means for moving the sheets supported on said first tray in a direction crossing with a direction of discharging of the sheet, to align the sheets; first driving means for driving said aligning means; a first sheet regulating member for regulating the sheets moved in a direction crossing with the discharging direction by said aligning means; second driving means for retracting said first sheet regulating member from said first tray; a second sheet regulating member disposed more remote from said aligning means than said first sheet regulating member; and moving means for moving the sheets supported on said first tray to second tray adjacent the first tray.

According to a further aspect of the present invention, there is provided a sheet stacking apparatus comprising sheet discharging means for discharging sheets; a first tray for stacking the sheets discharging by said discharging means; aligning means for moving the sheets supported on said first tray in a direction crossing with a direction of discharging of the sheet, to align the sheets; first driving means for driving said aligning means; a first sheet regulating member for regulating the sheets moved in a direction crossing with the discharging direction by said aligning means; second driving means for retracting said first sheet regulating member from said first tray; a second sheet regulating member disposed more remote from said aligning means than said first sheet regulating member; and moving means for moving the sheets supported on said first tray to a second tray adjacent said first tray; control means for controlling said second driving means to retract said first sheet regulating member and for controlling said first driving means to align a first one sheet of the set of the sheets by abutting it to said second sheet regulating member.

In this aspect of the present invention, it is preferable that said control means controls said second driving means so as to reset said first sheet regulating member to an upper surface of said first tray, and controls said first driving means so as to abut second and subsequent sheets of the set of the sheets to said first regulating member.

According to a further aspect of the present invention, there is provided a sheet stacking apparatus comprising sheet discharging means for discharging sheets; a first tray for stacking the sheets discharged by said discharging means; aligning means for moving the sheets supported on said first tray in a direction crossing with a direction of discharging of the sheet, to align the sheets; first driving means for driving said aligning means; a first sheet regulating member for regulating the sheets moved in a direction crossing with the discharging direction by said aligning means; second driving means for retracting said first sheet regulating member from said first tray; a second sheet regulating member disposed more remote from said aligning means than said first sheet regulating member; and moving means for moving the sheet supported on said first tray to a second tray adjacent said first tray; control means for controlling said second driving means to retract said first sheet regulating member and for controlling said first driving means to align a last one sheet of the set of the sheets by abutting it to said second sheet regulating member.

According to a further aspect of the present invention, there is provided a sheet stacking apparatus comprising sheet discharging means for discharging sheets; an alignment tray for stacking the sheets discharged by said discharging means in an aligned state; aligning means for aligning the sheets on said alignment tray by moving them in a direction crossing with a sheet discharging direction; a sheet regulating member disposed opposed to said aligning means; a stacking tray for receiving the sheets on said alignment tray; wherein said sheet regulating member is movable between a first position for receiving the sheet moved by said aligning means and a second position retracted from said first position to increase a movement distance through which the sheets are moved from said first position in a direction crossing with said discharging direction.

The present invention is also applicable to an image forming apparatus comprising an image forming section, and a sheet accumulation apparatus in which the sheets on which an image has been formed in the image forming section are discharged and accumulated in the same manner as described above.

With the provision of the above described structure, adjacent two sets of sheets are separated by a single sheet slightly displaced from the rest. More specifically, after the first set of sheets is accumulated in a first tray and is conveyed into a second tray, the first sheet regulating member is retracted to a position (second position) below the sheet accumulation surface of the first tray. Then, the first (bottommost) sheet of the following set of sheets is conveyed into the first tray, and this sheet is aligned on the second sheet regulating member by the abutting means. Thereafter, this sheet is conveyed into the second tray by the conveying means. At this point of the operation, the first set of sheets jogged by the first sheet regulating member, and the first sheet of the following set of sheets jogged by the second sheet regulating member, are displaced from each other in the direction perpendicular to the sheet discharge direction.

Further, the first sheet regulating member is returned to a position (first position) above the sheet accumulation surface of the first tray by the second driving means, and the second sheet and the sheets thereafter of the following set of sheets are conveyed into the first tray. The second sheet and the sheets thereafter of the following set of sheets conveyed into the first tray are jogged against the returned first regulating means by the abutting means, and then, are conveyed into the second tray by the moving means.

When the above operation is repeated, the bottommost sheet of the following set of sheets, which indicates the border between adjacent two sets of sheets, sticks out from between the first set of sheets and the second set of sheets. Therefore, even when multiple sets of sheets are conveyed into a single first tray and accumulated therein, they do not mix. As a result, the subsequent sorting step can be easily and efficiently carried out.

As described above, according to the sheet accumulation apparatus in accordance with the present invention, when multiple sets of sheets are accumulated in a single tray, the topmost sheet or the bottommost sheet of each set of sheets is slightly displaced from the rest, which causes the displaced sheets to stick out from the border of adjacent two sets of sheets. Therefore, even when multiple sets of sheets are accumulated in a single tray, they do not mix, making the subsequent sorting step easier to carry out, and thereby improving operational efficiency. Further, it becomes unnecessary for the apparatus to have a large number of trays. Consequently, increase in the apparatus size can be avoided, affording thereby cost reduction.

Further, size and cost reduction of a sheet accumulation apparatus can be realized by simplifying the structure which retracts the sheet regulating member.

Further, the same effects as those described above will be provided by an image forming apparatus comprising the above described sheet accumulation apparatus.

These and other object, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, the preferred embodiments of the present invention will be described with reference to the drawings.

Figure 1:
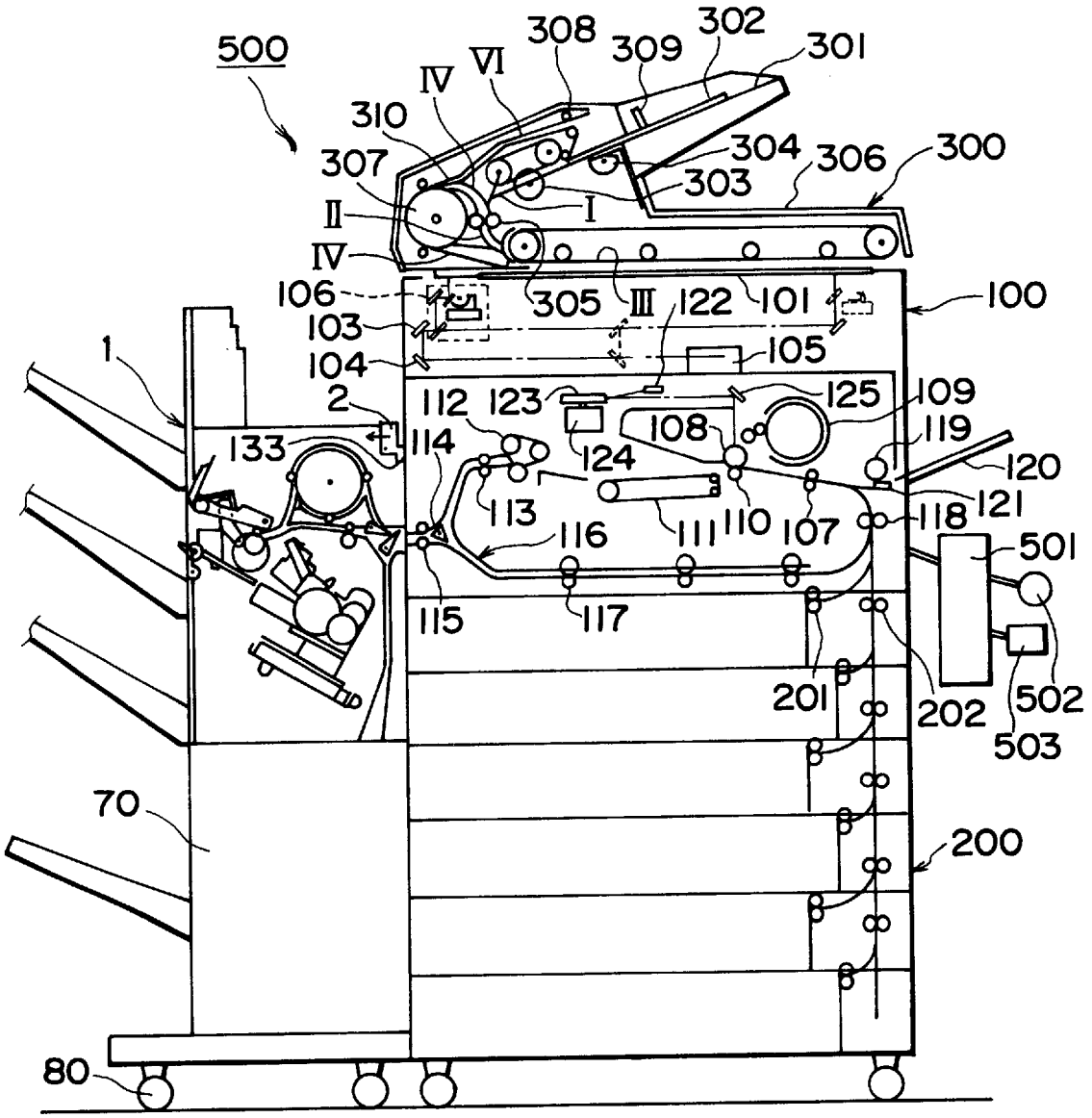
FIG. 1 is a sectional view of a sheet accumulation apparatus in accordance with the present invention, and a copying machine comprising the sheet accumulation apparatus.

FIG. 1 shows the internal structure of an image forming apparatus 50 to which the present invention is applicable. In this case, the apparatus is a copying machine. In the drawing, a reference numeral 1 designates the main assembly of a sheet accumulation apparatus in accordance with the present invention; 100, the main assembly, that is, the image forming section, of the copying machine; 200, a cassette capable of accommodating a plurality of sheets of different sizes; and a reference numeral 300 designates an apparatus for feeding originals (hereinafter, ADF) which automatically feeds a set of originals.

On the top surface of the sheet accumulation apparatus 1, a stopper member 2 is disposed. When the sheet accumulation apparatus 1 is connected to the copying machine main assembly 100, this stopper member 2 is engaged in a hold portion 133 provided on the lateral surface of the copying machine main assembly 100, so that the positional relationship between the two apparatuses can be accurately established. Below the sheet accumulation apparatus 1, a folding unit or an sheet accumulation apparatus placement table 70 is disposed. The table is provided with a caster 80 so that the apparatuses can be moved around.

Figure 2:
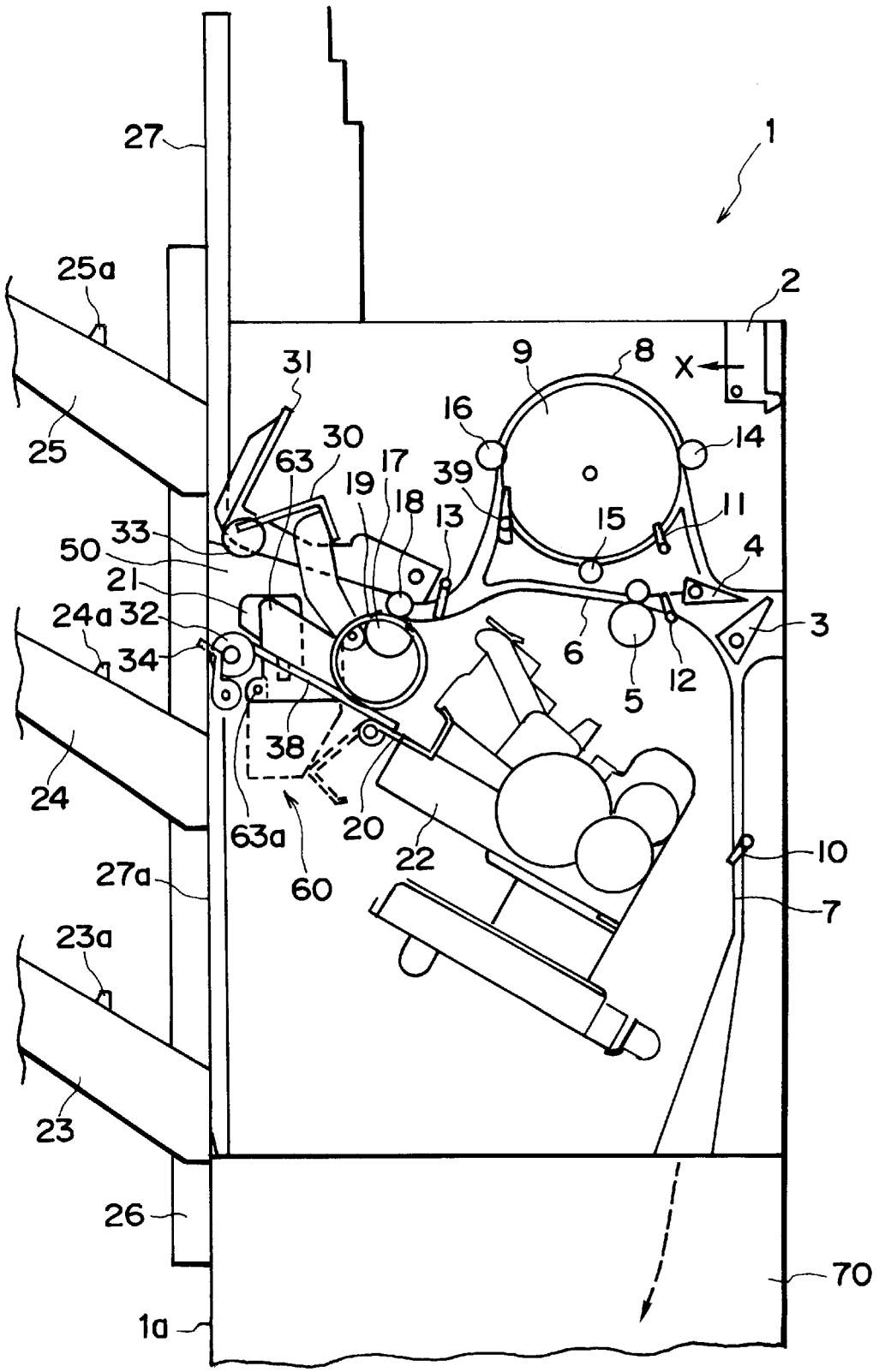
FIG. 2 is a more detailed sectional view of the sheet accumulation apparatus illustrated in FIG. 1.

Thus, a paper jam or the like, which happens to occurs adjacent to the sheet discharge portion of the copying machine main assembly 100, or the junction between the sheet accumulation apparatus 1 and the copying machine main assembly 100, can be easily handled just by rotating the stopper member 2 in the direction indicated by an arrow X in FIG. 2 to break its engagement with the hold portion 133, and then, horizontally moving the sheet accumulation apparatus 1 away from the copying machine main assembly 100.

The cut sheets (hereinafter, "sheets") on which an image has been formed are conveyed to either sheet accumulation apparatus 1, or an unillustrated folding apparatus disposed within the sheet accumulation apparatus placement table, depending on the processing necessary thereafter. In this embodiment, only a case in which the sheets are processed within the sheet accumulation apparatus 1 will be described.

Referring to FIG. 2, when the sheets are to be processed within the sheet accumulation apparatus 1, the upstream end of the first flapper 3 located closest to the copying machine main assembly 100 is directed forward, and the upstream end of the second flapper 4 located on the downstream side of the first flapper is directed upward. As a result, the sheets are sent to the first conveyance path 6 through a roller pair 5, and then, conveyed further downstream from the first conveyance path 6. On the other hand, when the sheets are to be conveyed to the folding apparatus, the upstream end of the first flapper 3 is directed upward as shown in the drawing, whereby the sheets are sent through the third conveyance path 7 to the folding apparatus disposed at a location ahead of a dotted arrow mark in the drawing.

Referring to the same drawing, a reference numeral 8 designates the second conveyance path (buffer path); 9, a buffer roller; 14, 15 and 16, buffer path rollers; and reference numerals 10, 11 and 12 designate sheet detection sensors, which detect a passing sheet as well as a staying sheet. A reference numeral 17 designates the first discharge roller, which is apart of discharging means; 18, a pressure roller, which also is a part of the discharging means; 19, a jog-discharge belt, which is a part of abutting means. The jug-discharge belt 19 is pinched by the first discharge roller 17 and the pressure roller 18, and is rotatively driven by the first discharge roller 17. Further, in order to prevent the belt from from dislodging, the jog-discharge belt 19 is provided with an unillustrated endless rib. This endless rib is disposed on the approximate center line of the internal surface of the belt, and is engaged with the first discharge roller 17.

Figure 3:
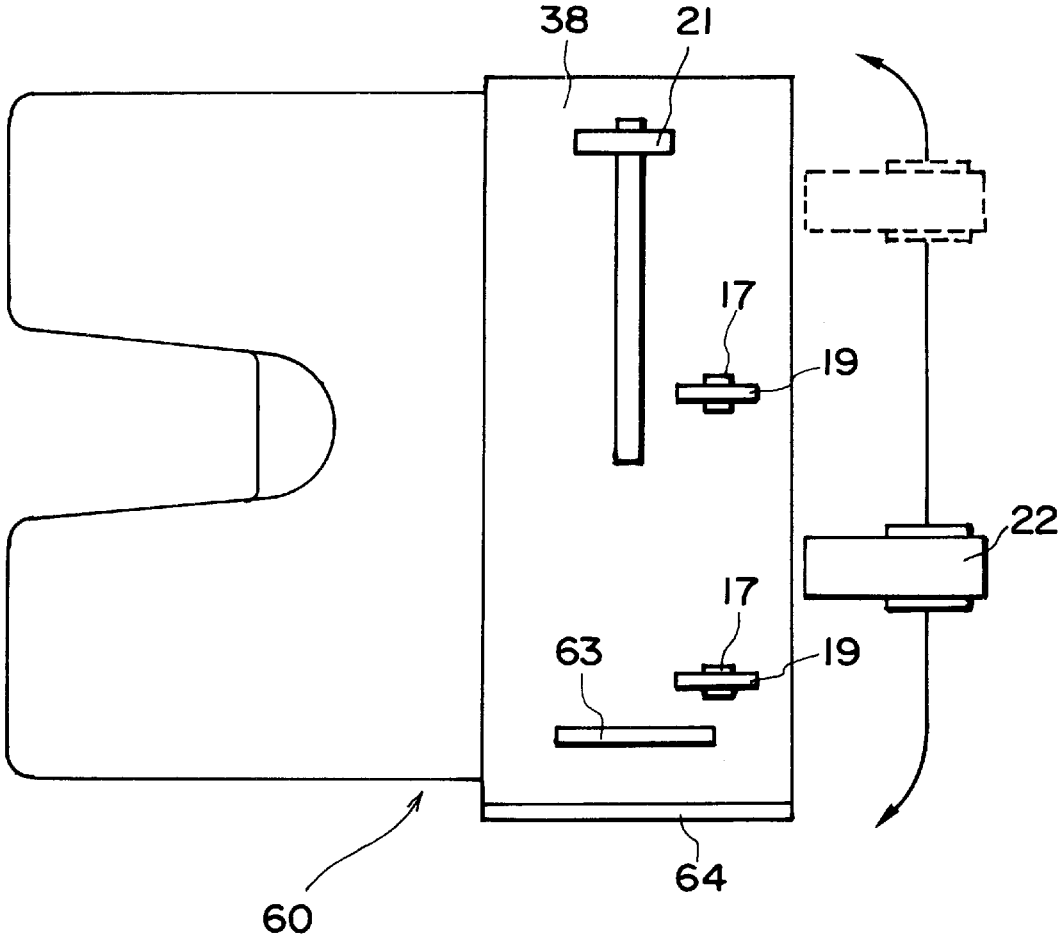
FIG. 3 is a plan view of the stapling tray of the sheet accumulation apparatus.

A reference numeral 25 designated a abutting plate, which is provided on a stapling tray, that is, the first tray (abutting tray), to jog the sheets (FIG. 3). A reference numeral 20 designates a trailing end regulating member capable of taking two positions: a home position for sequentially accumulating the sheets, and a retraction position where it is retracted when a stapler 22 is moved forward or backward. More specifically, the trailing end regulating member 20 shares the same space as the stapler 22; therefore, the trailing end regulating member 20 is rendered rotatively retractable to a position outlined with a dotted line when it is necessary to change the position of the stapler 22.

Next, referring to FIGS. 3–8, a sheet abutting section 60, which pertains to the gist of the present invention, will be described in detail.

Figure 4:
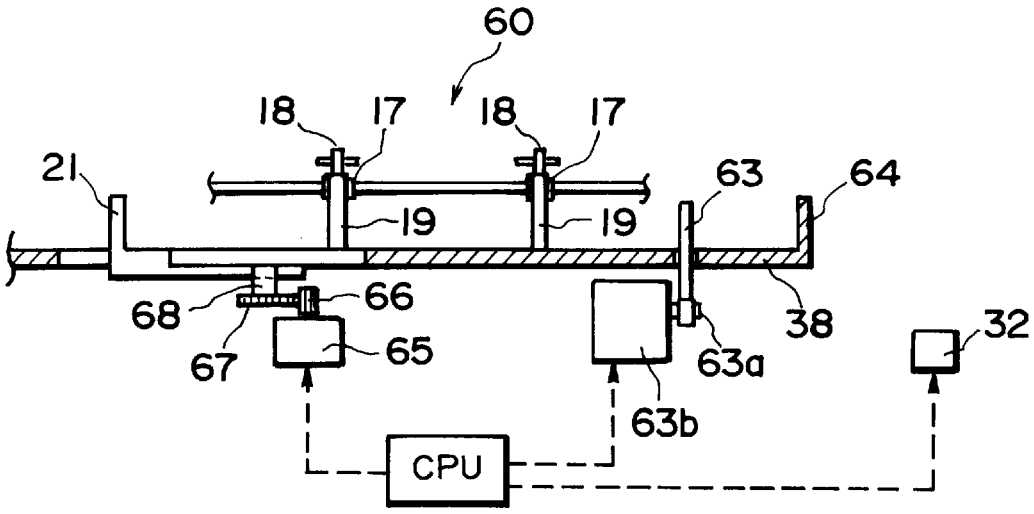
FIG. 4 is a sectional view of the stapling tray.

In this embodiment, the widthwise abutting of the sheets is carried out by a widthwise sheet shifting guide 21, shown in FIGS. 3 and 4, which functions as abutting means. The stapler 22 is rendered movable within a range indicated by arrow marks in FIG. 3, so that it can carry out three binding modes: a two point biding mode, a single point front binding mode, and a single point rear binding mode. The stapler 22 has substantially the same structure as a commercially available ordinary automatic stapling apparatus driven by a solenoid or an electric motor, and binds a set of sheets by striking a staple into a set of sheets. At this time, however, the detailed description of the operation of the stapler 22 will be omitted. Referring again to FIGS. 3 and 4, a reference numeral 63 designates an abutting reference plate which functions as a sheet regulating member (first sheet regulating member). As the abutting reference plate 63 is retracted, the moving rang of the widthwise sheet shifting guide 21 slightly increases to allow one sheet in each set of sheets to be slightly displaced from the others.

In a normal abutting movement, the widthwise sheet shifting member 21 moves in the horizontal direction of FIG. 4. This horizontal movement is caused by a motor 65 as the first driving means. More specifically, as a pinion gear 66 is rotated by the motor 65, the widthwise sheet shifting guide 21 is horizontally moved through a rack 67 and a linkage member 68. Then, as a sheet conveyed into the stapling tray 38 is moved to the right in FIG. 4 by the widthwise sheet shifting guide 21, it is nudged against the abutting reference plate 63 or a sheet regulating fixed member 64 as the second sheet regulating member, being thereby jogged.

Figure 5:
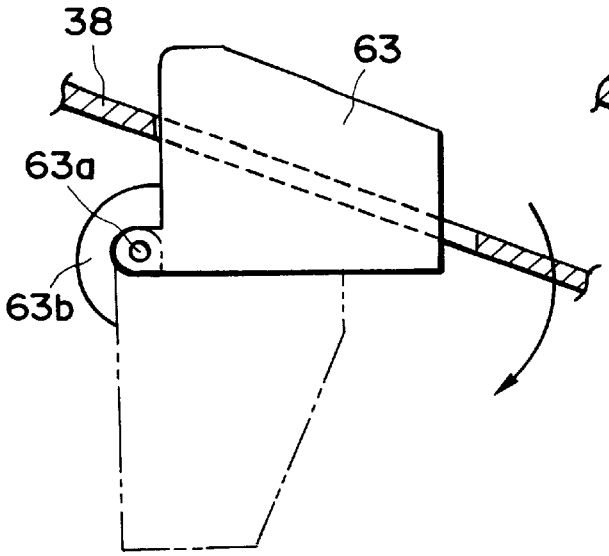
FIG. 5 is a sectional view of the abutting reference plate of the stapling tray and its adjacencies, depicting how the abutting reference plate is rotatively retracted.
Figure 6:
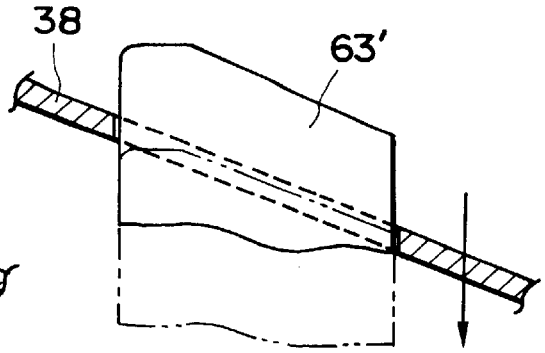
FIG. 6 is a sectional view of the abutting reference plate, and its adjacencies, depicting how the abutting reference plate is retracted downward.
Figure 7:
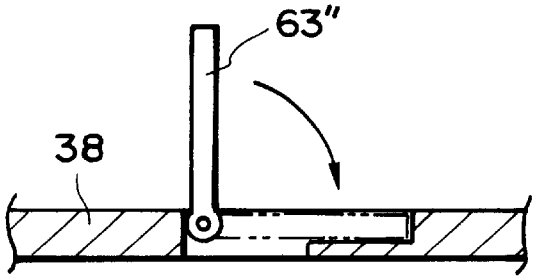
FIG. 7 is a sectional view of the abutting reference plate and its adjacencies, depicting how the abutting reference plate is rotatively retracted into the stapling tray.
Figure 8:
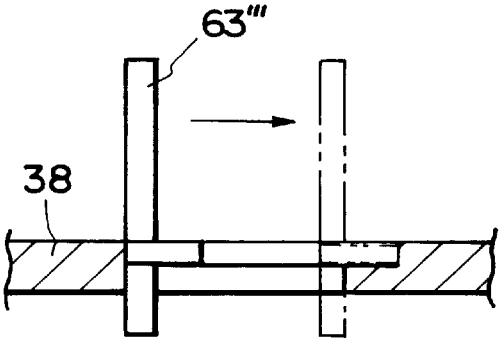
FIG. 8 is a sectional view of the abutting reference plate and its adjacencies, depicting how the abutting reference plate is retracted in the direction parallel to the surface of the stapling tray.

FIGS. 5–8 illustrate several examples of the method for retracting the abutting reference plate 63. The abutting reference plate 63 illustrated in FIG. 5 has a fairly large surface. It is rotatively retracted to a position below the sheet accumulation surface of the stapling tray 38 by a stepping motor **63*b* as the second driving means, by way of a rotational axis 63***a*. FIG. 6 shows another method, in which an abutting reference plate 63' is vertically retracted to a position below the sheet accumulation surface of the stapling tray 38. FIG. 7 shows another method, in which an abutting reference plate 63" is rotatively retracted into the stapling tray 38. FIG. 8 shows another method, in which a abutting reference plate 63"' is moved in the direction parallel to the direction in which the widthwise sheet shifting member 21 is moved. As the abutting reference plate 62 is retracted, a sheet is moved beyond the home position of the abutting reference plate 62, and is nudged against the fixed member 64, by the widthwise sheet shifting guide 21, being thereby jogged in a manner to be slightly displaced from the other sheets in a sheet set.

Referring again to FIG. 2, reference numerals 23, 24 and 25 designate the third, second and first trays from the top, each of which constitutes a second tray into which sheets are discharged from a discharge opening 50 formed in the side wall of the sheet accumulation apparatus 1. A reference numeral 26 designates a tray unit, to which these trays 23, 24 and 25 are attached, being tilted toward the sheet accumulation apparatus 1 and vertically aligned. The tray unit 26 is attached to the side wall surface 1*a* of the sheet accumulation apparatus 1 in a manner to allow the tray unit 26 to be vertically moved by an unillustrated driving power source disposed in the bottom portion thereof.

Also on the side wall surface of the sheet accumulation apparatus 1, top and bottom regulating guides (hereinafter, "slotted top guide" and "slotted bottom guide") 27 and 27*a* are provided, which come in contact with the lower ends (trailing ends) of the sheets discharged and accumulated into the trays 23, 24 and 25, and prevent the sheets from sliding upstream, that is, backward.

Next, referring to FIG. 1, the structure of the copying machine main assembly 100 will be described. In the copying machine main assembly 100 as the image forming portion, a reference numeral 101 designates a glass plate on which a sheet of original is placed; 103 and 104, scanning deflection mirrors (scanning mirrors) for changing the direction of the light reflected by the original; 105, a focusing lens with variable power; 106, a first scanning mirror comprising an illumination lamp for reading the original sent from the ADF 300; 107, a registration roller; 108 and 110, a photosensitive member and a pressure roller, respectively; 111, a conveyer belt for conveying a recording sheet, on which an image has been recorded, toward a fixing apparatus; and a reference numeral 112 designates a fixing device for thermally fixing the recording sheet.

Reference numerals 113 and 117 designate a conveyor roller; 114, a flapper for switching the direction in which the delivered recording sheet is conveyed; 115, a conveyer roller for conveying the recording sheet toward the sheet accumulation apparatus 1; 116, an inversion path for inverting the recording sheet; 118, a conveyer roller for conveying a sheet from the sheet feeder cassette to a photosensitive drum unit; 119, 120 and 120, a conveyer roller for conveying a sheet from a manual sheet feeder unit to the photosensitive drum unit, a manual feeder tray, and a separation pad, correspondingly; 122, 123 and 125, a laser, a polygon mirror, and a light path changing mirror, correspondingly, which form an image on a photosensitive drum; and a reference numeral 124 designates a motor for driving the polygon mirror 123.

A reference numeral 200 designates a sheet feeder cassette capable of accommodating various sheets of a different size, with the provision of dedicated compartments for different sizes, and also capable of sending an appropriate sheet to the copying machine main assembly 100 is response to a signal from the copying machine main assembly 100; 201, a conveyer roller for pulling out a sheet from the cassette 200; and a reference numeral 202 designates an intermediate roller for mediating the upward conveyance of a sheet pulled out from the cassette 200. The surface of the photosensitive drum 103 is covered with a seamless photosensitive material composed of a photosensitive material and an ordinary electrically conductive material. This drum 108 is rotatively supported by an axis, and is rotated in the direction of an arrow mark in the drawing, by a main motor (unillustrated) which rotates in response to the pressing of a copy start key. After the completion of a revolution control process and a voltage control process (pre-image formation processes), the original placed on the original placement glass plate 101 is illuminated by the illumination lump integrated with the first scanning mirror 106. The light reflected by the original is deflected by the scanning mirrors 103 and 104, transmitted through the lens 5, and forms an optical image as it is focussed on a light reception element deposed within the lens unit.

The optical image formed on the light reception element by the reflected light from the original is converted into electric signals, and thus generated electric signals are sent to an image processing section (unillustrated). In the image processing section, after the electric signals are subjected to a predetermined data processing procedure in response to the instruction given to the copying machine main assembly 100 by a user, the electric signals are sent to a laser 112. The electric signals having been subjected to the data processing procedure are converted into light in the laser 112. Then, the thus generated light is deflected by polygon mirrors 123 and 125, forming an electrostatic latent image on the photosensitive member. Then, the latent image is visualized as a toner image using toner, and the toner image is transferred onto a sheet of transfer paper which will be described later.

As for the sheet of transfer paper placed in the cassette 200 or the manual feeder tray, it is sent into the copying machine main assembly 100 by the sheet feeder rollers 118, 119, 201 and 202, and further conveyed toward the registration roller 109 with precise timing so that the leading end of the latent image and the leading end of the transfer paper synchronously arrive in the transfer portion. Thereafter, the toner image on the drum 108 is transferred onto the transfer paper as the transfer paper is passed between the photosensitive member 103 and the roller 110.

After the transfer of the other image, the transfer paper is separated from the photosensitive drum 108, and is guided to the fixing device 112 by the conveyer belt 111. In the fixing device 112, the toner image is fixed to the transfer paper by heat and pressure.

In the ADF 300, a reference numeral 310 designates an original set placement tray on which a set of original is placed. The sheets in a set of original placed on the original placement tray 310 are separated one by one from underneath by a half-moon roller 304 and a separation roller 303, and are conveyed to the original placement glass plate 101 by a conveyer roller 350 and a full-width belt 306, through paths I and II. As the first sheet of original is positioned at the exposure position, the ADF 300 is temporarily stopped, being prepared for the starting of a subsequent copying operation.

In the case of single sided originals, after the copying operation, the sheet of original is sent back to the original set placement tray 310 by a large conveyer roller 307 through paths IV and VI, and is deposited on the topmost sheet of the set of sheets of original 302 by the discharge roller 308. A reference numeral 309 designates a recycle lever for detecting a single full circulation of all the sheets in the set of originals. More specifically, the recycle lever 309 is placed on top of the set of originals. As the sheets of original are sequentially circulated through the ADF 300, and the last sheet of original is pulled away from underneath the recycle lever 309, the recycle lever 309 falls down due to its own weight, signaling the completion of a single full circulation of all the sheets in the set of originals.

On the other hand, in the case of double sided originals, each sheet of original is first introduced into the path III through the paths I and II, and then, the direction of a pivotable sheet path change flapper 310 is switched to introduce the leading end of the sheet of original into the path IV. Then, the sheet of original is passed through the path II by the conveyer roller 305, and conveyed onto the original placement glass plate 101 to be set thereon. In other words, the sheet of original is inverted by the coordinated functions of the large conveyer roller 307 and an inversion path constituted of the paths III–IV–II.

Figure 11:
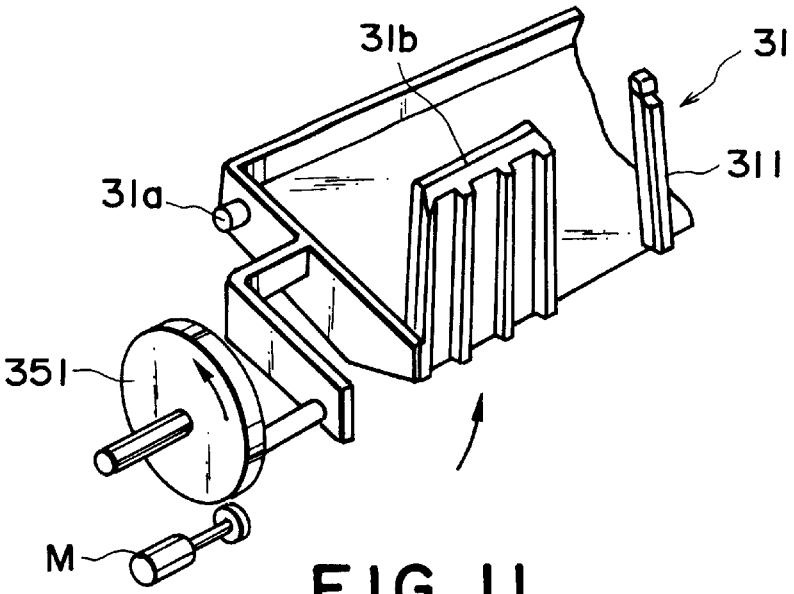
FIG. 11 is a perspective view the oscillating guide of the sheet accumulation apparatus, and its adjacencies, depicting how the oscillation guide is oscillated.
Figure 12:
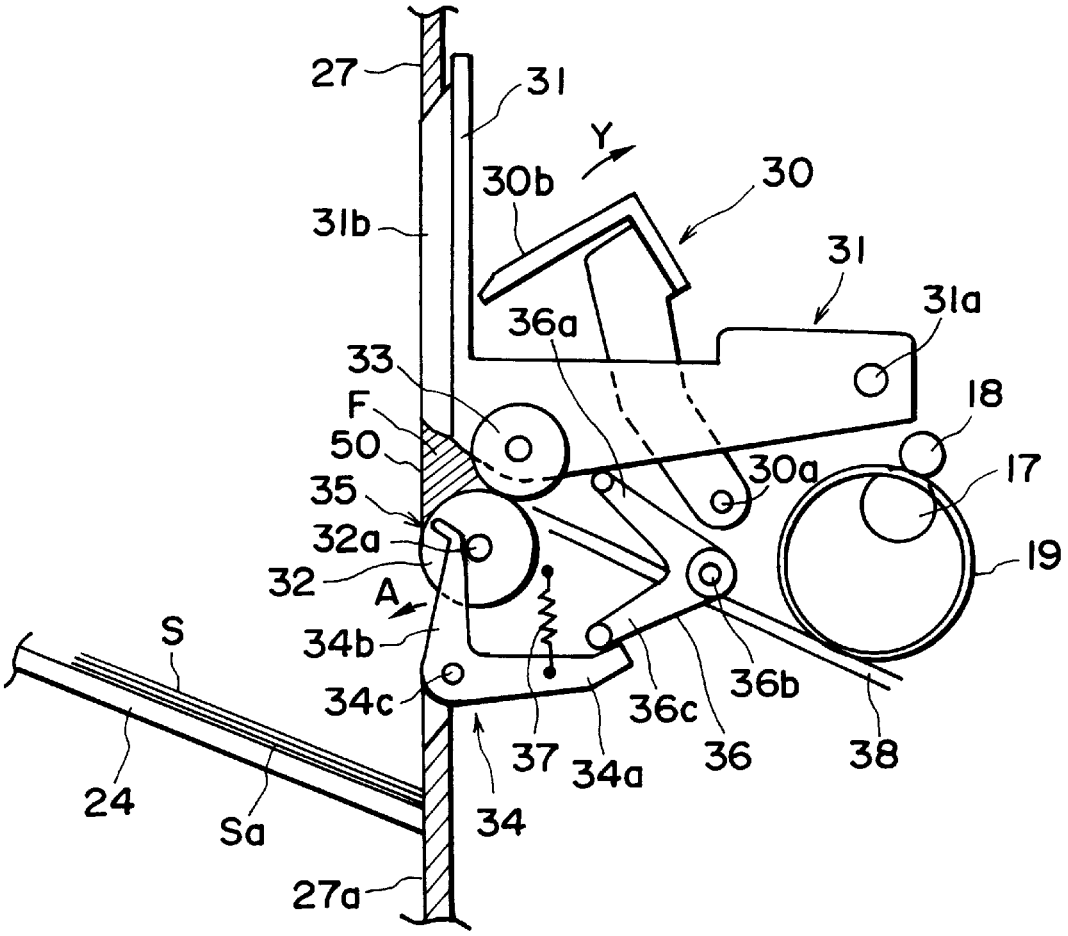
FIG. 12 is an enlarged sectional view of one of the essential portions of the sheet accumulation apparatus.
Figure 13:
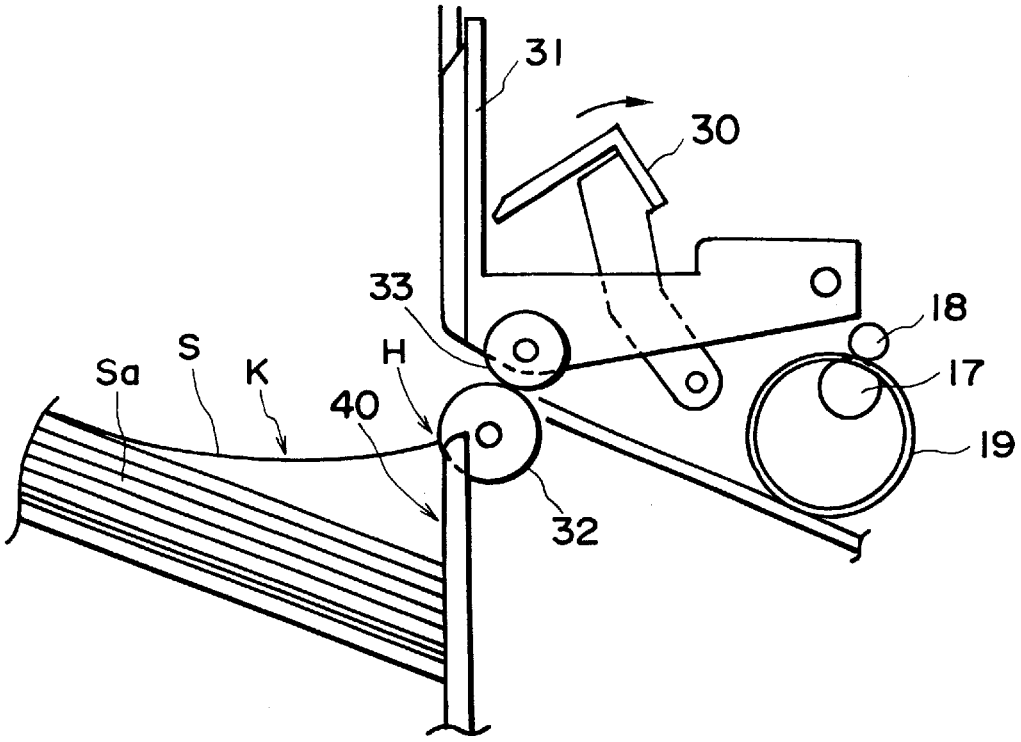
FIG. 13 is an enlarged sectional view of the same as the above, depicting how a sheet sags as its trailing end hangs up on the top edge of the slotted bottom guide.

Next, the sheet discharging structure of the sheet accumulation apparatus 1 will be described in detail with reference to the drawings. Referring to FIGS. 12 and 13, a reference numeral 31 designates an oscillation guide as the oscillation member. The oscillation guide 31 rotatively holds a movable discharge roller 33 as a part of moving means, and presses the movable discharge roller 33 onto the discharge roller 32 as another part of the moving means, as shown in FIG. 12. More specifically, when discharging a sheet, a cam 351 illustrated in FIG. 11 is rotated in the direction of an arrow mark in the same drawing by a driving power source M, so that the oscillation guide 31 is oscillated downward about an oscillation axis 31*a* to apply downward pressure to the movable discharge roller 33. Further, when in a stapling mode which will be described later, the oscillating guide 31 is oscillated upward to separate the movable discharge roller 33 from the discharge roller 32, disabling the sheet conveying function provided by the movable discharge roller 33 and the discharge roller 32. In other words, the oscillation guide 31 plays a role as switching means for switching the relationship between the movable discharge roller 33 and the discharge roller 33, between a sheet conveyance enabled state and a sheet conveyance disabled state. Further, the sheet nudging surface 31*b* of the oscillation guide 31 is provided with a rib 311 (FIG. 11).

Figure 16:
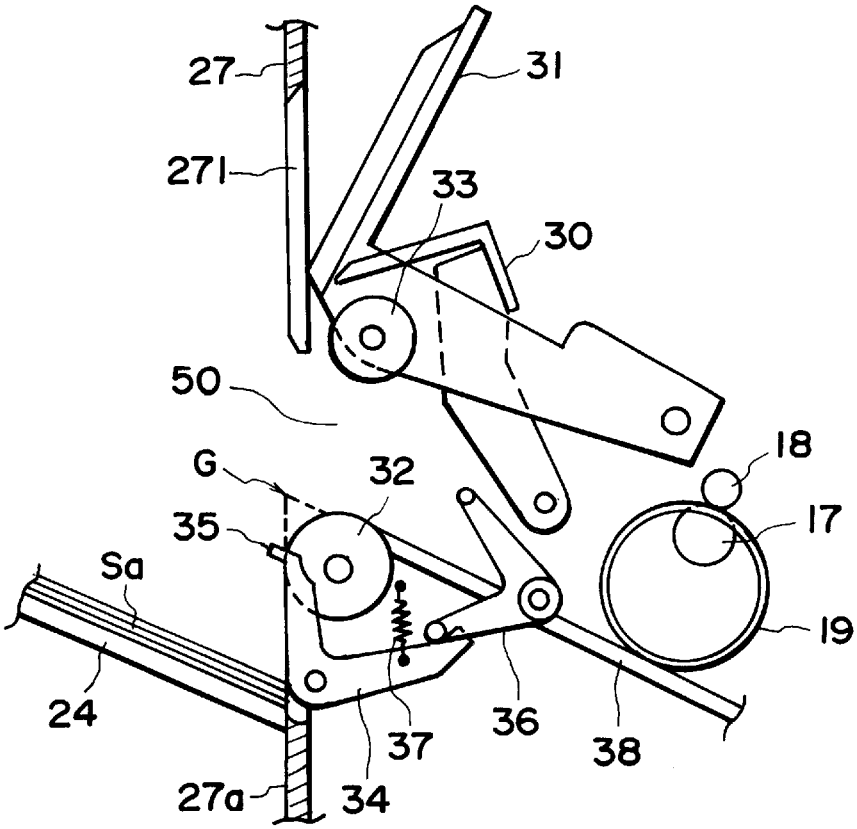
FIG. 16 is an enlarged sectional view of the same, depicting the sate of the roller guide at the second position.

Referring to FIG. 12, a reference numeral 30 designates a stopper rotatable about a rotational axis 30*a*. When moving the trays, the stopper 30 is rotated to a position outlined with a solid line in FIG. 13, and held there, so that the discharge opening 50 is blocked by a shutter portion 30*b* provided on the top end of the stopper 30. With the provision of the above structure, when the tray 24 holding the accumulated sheets passes the F section and the discharged opening 50, the sheets S having been accumulated on the tray 24 are prevented from moving upstream, that is, backward, into the discharge opening 50. When discharging sheets, the stopper 30 is rotated in the direction of an arrow mark Y in FIG. 12 to unblock the discharge opening 50. Further, when in a stapling mode which will be described later, it is rotated in the same direction as the oscillation guide 31 as shown in FIG. 16 to unblock the discharge opening 50. Further, the stopper 30 and slotted top guide 27 are provided with ribs similar to those provided on the oscillation guide 31.

Therefore, the oscillation guide 31 and stopper 30 form a flat surface which bridges between the slotted top and bottom guides 27 and 27*a,* so that the sheets having been accumulated on the tray 24 are allowed to vertically move, and the stopper 30 prevents the rotational movement of the oscillation guide 31 in the opening direction, that is, the stopper 30 also functions as a member for holding the oscillation guide 31.

Also referring to FIG 12, a reference numeral 34 designates a roller guide, which is a guide member for guiding the discharged sheet S to the tray 24. As shown in the drawing, the roller guide 34 is a rotatable member comprising a horizontal arm 34*a* and a vertical arm 3*b,* wherein the vertical arm 34*b* is perpendicularly erected from the horizontal arm 34*a*. It is horizontally disposed immediately below the discharge opening 50. A reference numeral 31*a* designates a driving axis to which the discharge roller 32 is fixed. It is rotatively driven by an unillustrated driving means. A reference numeral 34*c* designates an oscillation axis portion to which the roller guide 34 is rotatively attached, wherein the roller guide 34 is kept under pressure generated in the direction of an arrow mark A in FIG. 12 by a spring 37 attached to the horizontal arm 34*a,* and when in the stapling mode, it is moved to be retained at a position illustrated in FIG. 16 (hereinafter, second position), at which its surface becomes level with that of the slotted bottom guide 27*a,* so that even if the trailing end of a sheet S in a sheet set S accumulated in the tray 24 happens to lean on the side wall of the sheet accumulation apparatus 1, with the middle portion of the sheet S sagging, it is prevented from hanging up between the slotted bottom guide 27*a* and the discharge roller 32.

Normally, the sheets discharged by the discharge roller 32 and movable discharge roller 33 are sequentially accumulated in the trays 24. However, if the structure of the slotted guiding surface is as simple as that of a guide member 40 illustrated in FIG. 13, the trailing end of a discharged sheet is liable to hang up at the transfer point between the discharge roller 32 and guide member 40, preventing the sheet from being completely discharged, when a sheet is still holding the charge resulting from image formation, when the coefficient of inter-sheet friction is too high for desirable sheet discharge, or when the like situations occur. Therefore, the slotted bottom guide 27*a* is provided with ribs. With the provision of the above structure, the friction between the trailing end of a sheet and the slotted bottom guide 27*a* is sufficiently reduced to allow sheets to accumulate in the tray 24 without hanging up by the trailing end.

Figure 25:
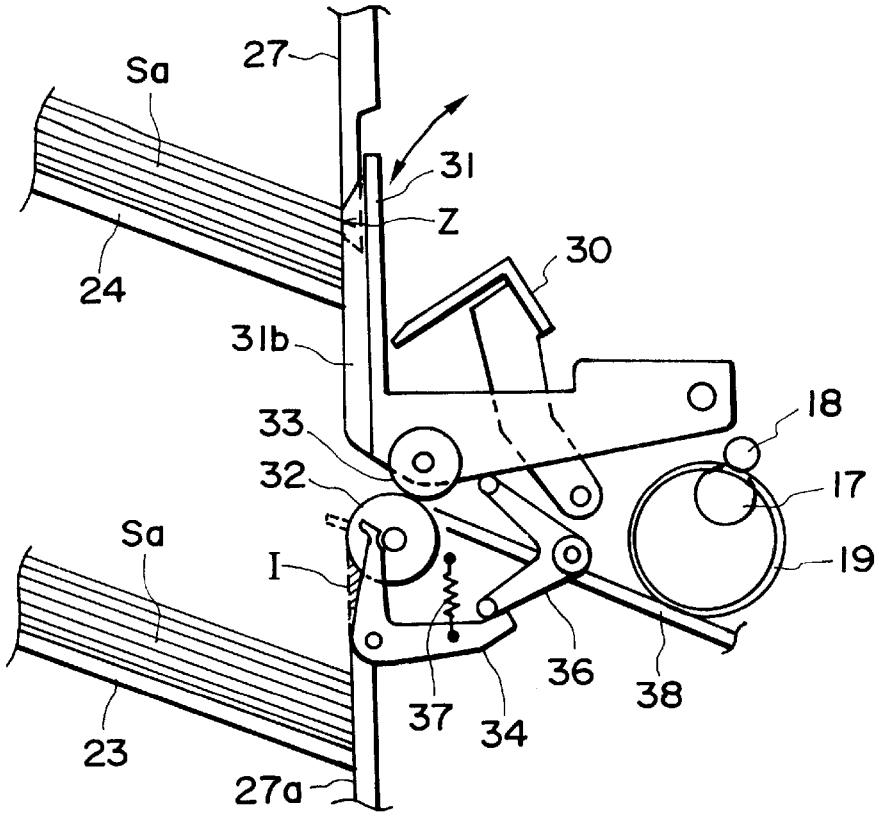
FIG. 25 is a schematic sectional view of the sheet accumulation apparatus, depicting how the second and third trays from the top are shifted upward and downward, respectively.

Further, the provision of the above structure eliminates the need for extending or retracting the slotted top guide 27, or providing a separate slotted guide which can be moved into, or moved away from, the gap below the slotted top guide 27; therefore, the structure can be simplified. Further, the above provision makes it possible to use the surface of the rib 311 of the sheet nudging surface of the oscillation guide 31, as the extension of the slotted top guide 27, as shown in FIG. 25; therefore, the intervals among the trays can be narrowed. Referring to FIG. 25, as the oscillation guide 31 is rotated in the direction of the arrow mark in the drawing, the discharge opening is widened or narrowed. Therefore, normally, after the maximum number of sheets are accumulated in the tray 23, the tray 24 must be located above the bottom end point Z of the slotted top guide 27 because of the following reason. For example, a stapling operation, which will be described later, is carried out while the accumulated sheets are still in the tray 24. Therefore, as the oscillation guide 31 is rotated upward, the sheets having been accumulated below the point Z are liable to slide down from the tray 24 toward the stapling tray 38.

Thus, when carrying out a stapling operation, the interval between the trays 23 and 24 must be at least as large as the distance between the surface of the top sheet of the set of sheets accumulated in the trays 24 to its maximum capacity, and the point Z. However, such a requirement is not mandatory when choice in operational mode is limited. For example, if the operational mode, which is available when the sheets accumulated in the tray 24 remain therein while sheets are discharged into the tray 23, is limited to a non-stapling operation, the oscillation guide 31 does not need to be rotated upward; therefore, the sheet nudging surface 31*b* of the oscillation guide 31 can be used as an extension of the slotted to guide 27. With this arrangement, it is possible to allow the tray 24 to descend below the point Z while the sheets remain in the tray 24. Therefore, the interval beaten the adjacent two trays can be narrowed to reduce the size of the tray unit.

Referring to FIG. 16, in this embodiment, the top end of the vertical arm 34*b* is provided with an engagement claw 35, which projects outward of the apparatus. This engagement claw 35 projects upward of the tray 24 when the roller guide 34 is held at the second position. With the provision of the above arrangement, even when the trailing end of the topmost sheet S of the sheet set Sa having accumulated in the tray 24 happens to lean on the side wall of the sheet accumulation apparatus 1, with its middle portion sagging, the trailing end can be prevented from reaching beyond a point G (FIG. 16); therefore, it is possible to prevent a sheet from hanging up and causing a paper jam as the following sheet is discharged, or from hanging up and increasing the load against the abutting movement of the widthwise sheet shifting guide 21.

The oscillating movement of the roller guide 34 is linked to the movement of the oscillation guide 31 by was of a linkage member 36. In other words, as the oscillation guide 31 is oscillated downward to push down the upper arm 36*a* of the linkage member 36 as shown in FIG. 12, the linkage member 36 is rotated downward about a rotational axis 36*b*. Consequently, the horizontal arm 34*a* of the roller guide 34 is pushed down by the lower are 36*c* of the linkage member 36.

As the horizontal arm 34*a* is pushed down, stretching the spring 37, the roller guide 34 is oscillated to be retracted to a position (hereinafter, first position) at which the tip of the engagement claw 35 does not projects beyond the outward facing peripheral surface of the discharge roller 32 (FIG. 12). This spring 37 and the linkage member 36 constitute means for rotating the roller guide 34.

With the provision of the above arrangement for retracting the roller guide 34 to the first position, the sheet S is prevented from hanging up between the roller guide 34 and discharge roller 32 when being discharged. In other words, the sheet S is reliably discharged. Further, referring to FIG. 14, the above structure also provides a recess I, which is illustrated by hatches in FIG. 14, between the roller guide 34 and the slotted bottom guide 27*a*, reducing the surface area which creates friction. Therefore, the discharged sheet S is allowed to smoothly fall into the tray 24.

On the other hand, as the oscillation guide 31 is oscillated upward, allowing the linkage member 36 rotating upward, the roller guide 3 is return to the second position illustrated in FIG. 16 by the resiliency of the spring 37. As the roller guide 34 is returned to the second position, the recess I is eliminated, and the elimination of the recess I prevents the sheet S from hanging up when the apparatus is in the stapling mode.

Next, the operation of the sheet accumulation apparatus 1 constructed in the above described manner, and the operation of the image forming apparatus 500 comprising the sheet accumulation apparatus 1, will be described.

Figure 9:
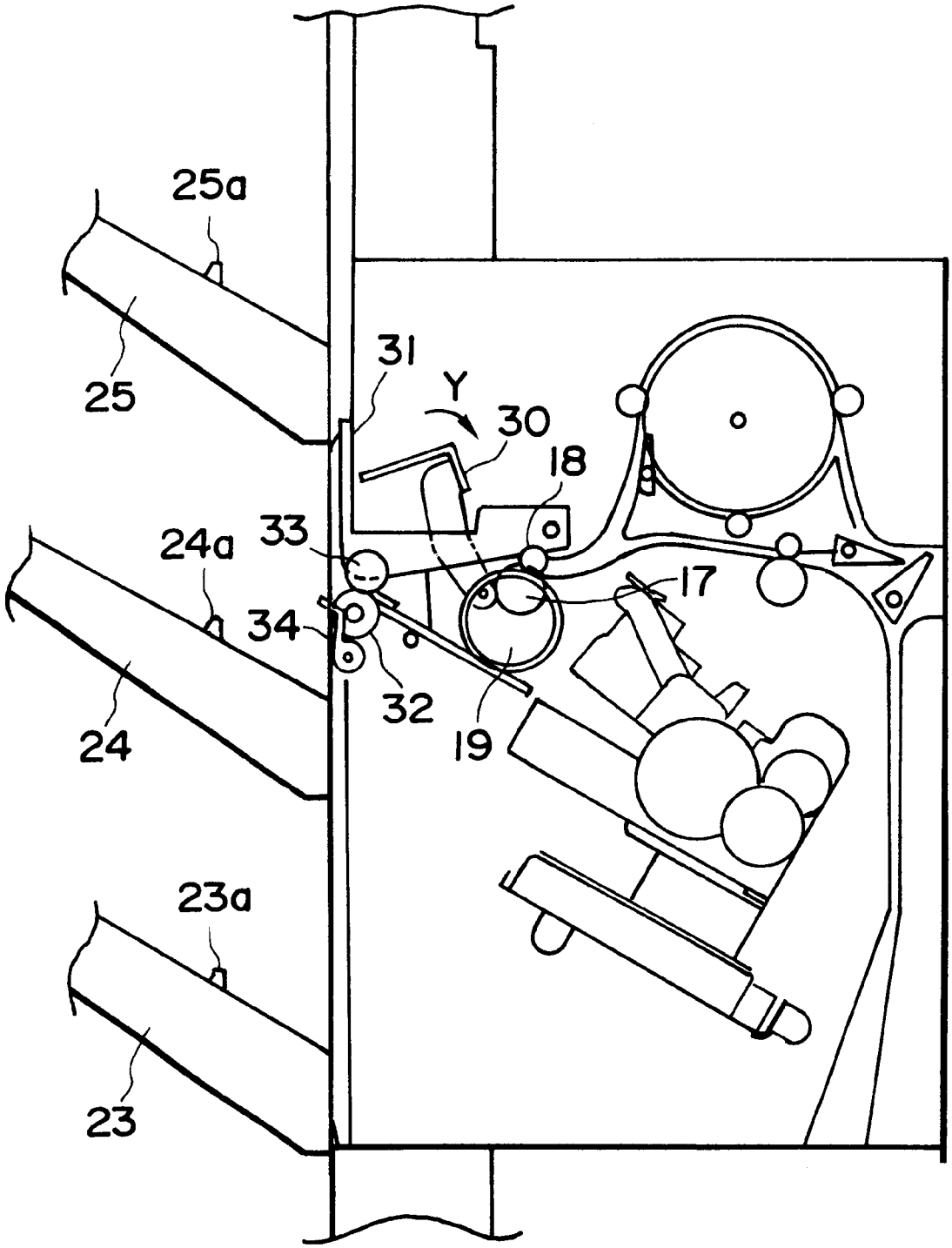
FIG. 9 is a sectional view of the sheet accumulation apparatus in which a sheet is being discharged into the second tray of the sheet accumulation apparatus.

When sheets are discharged without stapling, they are directly discharged into the trays 23, 24 and 25, which are the third, second and first trays counting from the top, and are all second order trays in terms of sheet transfer. First, referring to FIG. 9, a case in which sheets are discharged into the tray 24, the second tray from the top, will be described. As a non-stapling mode is selected by the user, the oscillation guide 31 is oscillated by the cam 351 (FIG. 11) to a position at which the movable discharge roller 33 is caused to press on the discharge roller 33 as shown in FIG. 12. At this point of time, the stopper will have been rotated in the direction of an arrow mark Y, being held there, and the roller guide 34 will have been held at the first position by the oscillation guide 31 and the linkage member 36, with the engagement claw 35 having been retracted below the outward facing peripheral surface of the discharge roller 32.

With the sheet accumulation apparatus 1 being in the above described state, the sheets discarded from the copying machine main assembly 100 are conveyed through the path 6, which is illustrated in FIG. 2, and are relayed to a pair of rollers 17 and 18 to be conveyed further downstream. Thereafter, the sheets are directed toward the tray 24 by the oscillation guide 31, are passed between the discharge rollers 32 and 33, are discharged from the discharge opening 50, and are sequentially deposited in the trays 24 (FIG. 12). With the sheet accumulation apparatus 1 being in the above state, even when the sheet S is not discharged with sufficient velocity from the discharge opening 50 due to such conditions of the sheet S that the sheet S is till holding the charge or the inter-sheet friction is rather high, the presence of the roller guide 34 at the first position prevents the sheet S from hanging up on the discharge roller 32, and the presence of the recess I between the discharge roller 32 and the slotted bottom guide 27*a* allows the sheet S to smoothly descend into the tray 24 without interference.

Next, a case in which a large number of copies are made using plain sheets S will be described. First, it is confirmed by sheet-presence sensors 23*a*, 24*a* and 25*a* (FIG. 2) provided in the corresponding trays 23, 24 and 25 that there is no sheet in the trays 23, 24 and 25. Then, the tray unit 26 is moved to a predetermined position so that the tray 23 is enabled to receive the first sheet. As the number of sheets accumulated in the tray 23 reaches a predetermined value, the tray unit 26 is lowered to a predetermined position so that the top surface of the accumulate sheets is lowered to the level at which the surface of the tray 23 was located when it received the first sheet. This operation is repeated until the sheets are accumulated in the tray 23 to its maximum capacity. As soon as it is detected that the maximum capacity of the tray 23 has been reached, a stop signal is sent to the copying machine main assembly 100 to temporarily hold sheet discharge.

Next, in order to accumulate sheets in the tray 26, the tray unit 26 is lowered to a predetermined position at which the first sheet for the tray 24 is to be deposited in the tray 24. Then, the copying machine main assembly 100 is instructed to restart the copying operation. After, the copying operation is restarted, the operation described in the foregoing paragraph with reference to the tray 23 is repeated until the tray 24 is filled to its maximum capacity. It should be noted here that when switching the sheet accumulating operation from the tray 24 to the tray 25, switching is made in the same manner as the switching from the tray 23 to the tray 24.

The coping machine main assembly 100 in this embodiment is of a digital type, and comprises a scanner section which reads the image on a sheet of original, and a printer section which reproduces the image, wherein each section can be independently operated. More specifically, in the scanner section, a sheet of original is illuminated with a lamp. Then, the light reflected from the original is broken down into microscopic dots (picture element), and converted into electric signals corresponding to the optical density of the original, by a light reception element (photoelectric conversion). In the printer section, a copy of the original image is formed through a process in which an electrostatic latent image is formed on a drum by scanning the drum by a laser beam reflecting the electrical signals sent from the scanner section, a process in which the latent image is developed with developer, a process in which the developed image is transferred, and a process in which the transferred image is fixed.

Therefore, the imaging signals generated by the scanner section can be transferred to a facsimile machine 502 by connecting an interface 501 to the digital copying machine as shown in FIG. 1, and also, the electric signals received from the facsimile machine 502 can be sent to the printer section through the interface 501 to be reproduced into an image on a sheet of transfer paper. Further, the image signals received from a computer device 503 such as a personal computer may be sent to the printer section to be reproduced into an image on the transfer sheet, or the image read by the scanner section may be fed into a personal computer through the interface 501.

As described above, with the provision of the interface 501, a latest digital copying machine can be used not only as a copying machine which copies an original by reading the original which is sent from the ADF 300 and is placed on the original placement glass plate 101, but also as a facsimile machine or a printer for a personal computer.

However, in order for the copying machine 100 to be usable in a more productive manner, the copying machine 100 must be capable of sorting sheets into separate trays, or specific trays numbered and selected by the user. Therefore, in this embodiment, the tray 23 is designated to accumulate the sheets (hereinafter, facsimile sheet) related to a facsimile machine; the tray 24 is designated to accumulate the sheets (hereinafter, computer sheet) related to a personal computer; and the tray 25 is designated to accumulate the sheets (hereinafter, copy mode sheet) when the copying machine 100 is in a copying mode. Next, the operation for discharging sheets into specific trays will be described.

Figure 10:
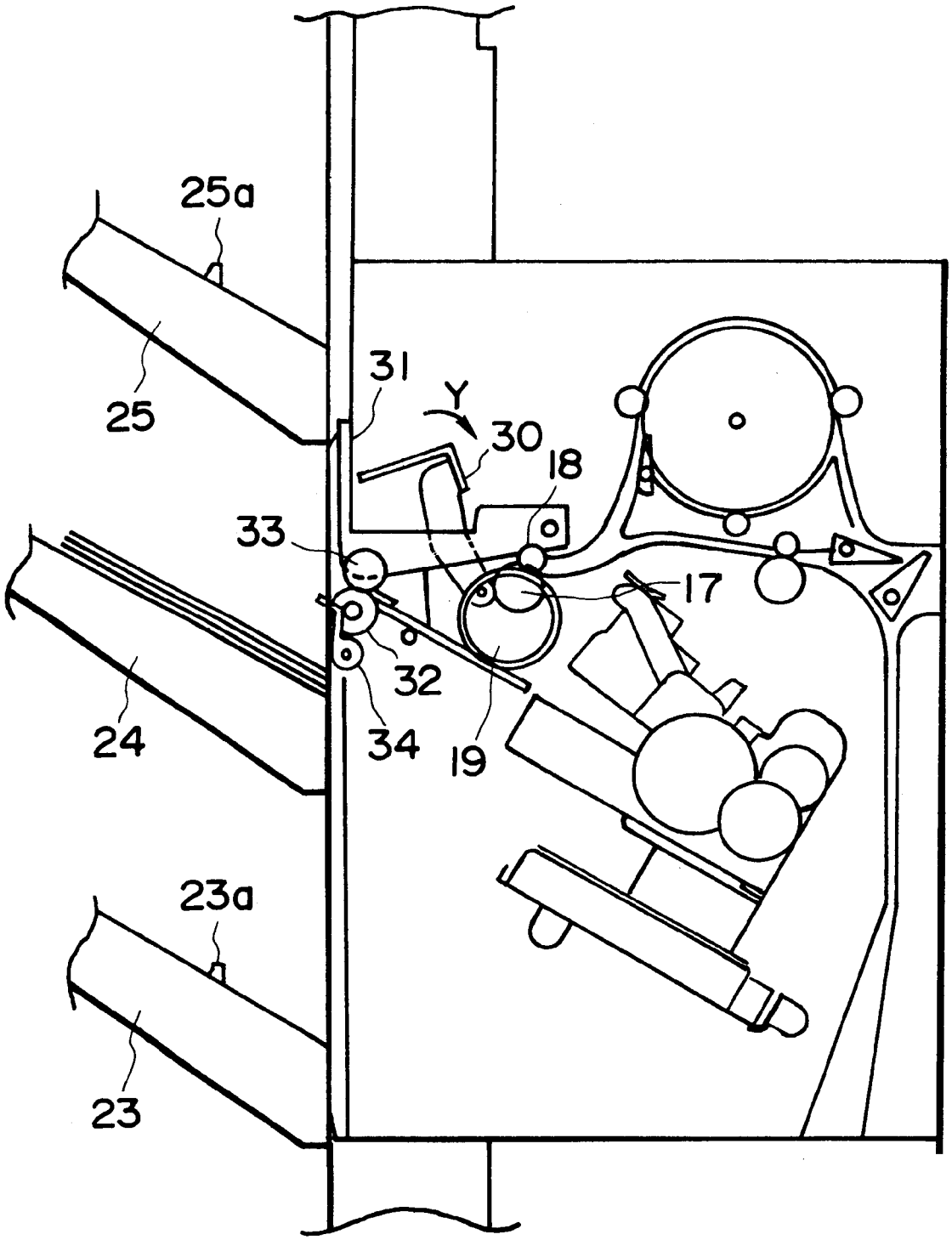
FIG. 10 is a sectional view of the sheet accumulation apparatus in which the sheets outputted from a personal computer have been discharged into the second tray.

First, referring to FIG. 10, a case in which the copy mode sheet S is discharged after a certain number of the computer sheets have been received and are remaining in the tray 24, that is, a case in which the tray 25, the first tray from the top, is used will be described. When the first tray 25 is used after a certain number of the computer sheets have been received and are remaining in the tray 24, the tray unit 26 (FIG. 2) is lowered so that the tray 25 is positioned to receives the first sheet for the tray 25. This operation for lowering the tray unit 26 is the same as the operation for lowering the tray unit 26 during an ordinary copying mode, except that the tray 24 has not been filled to its maximum capacity.

Figure 15:
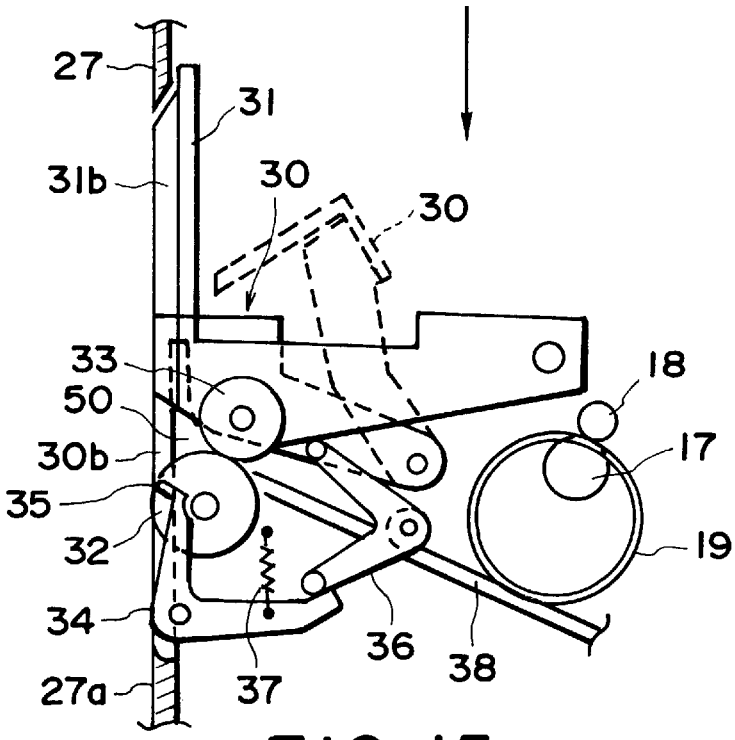
FIG. 15 is an enlarged sectional view of the same, depicting the state of a stopper which is blocking the opening of an F section.

Next, a case in which the facsimile sheets are accumulated after a certain number of the computer sheets have been received and are remaining in the tray 24, the second tray from the top, will be described. In other ways, a case in which the tray 23, the third tray from the top, is used will be described. In order to accumulate sheets in the third tray 23 while the sheets accumulated in the second tray 24 remain in the second tray 24, the tray unit 26 is raised. At this point of time, the stopper 30 is rotated to a position indicated by a solid line in FIG. 15 so that the shutter portion 30*b* closes the space F, an area hatched in FIG. 12, to prevent the sheet S from entering the space F. As a result, it becomes possible to move the second tray 24 upward while it is still holding the sheet S. The sheet nudging surface of the shutter portion 30*b* is provided with ribs so that the sheet S can slide on the sheet nudging surface as easily as on the sheet nudging surface 31*b* (FIG. 11) of the oscillation guide 31 and on the surface of the slotted bottom guide 27*a*.

With the provision of the above described structure, the sheet S can pass the location of the discharge opening 50 without sliding upstream into the discharge opening 50. Therefore, it becomes possible to move upward the second tray 24 while it is still holding the accumulated sheets. Also, as will be described later, the interval between the adjacent trays can be narrowed by making the sheet nudging surface of the oscillation guide 31 function as the extension of the slotted top guide 27, so that the size of the tray unit 26 can be reduced.

Even though the operation described above is an operation for switching from the second tray 24 to the third tray 23, the tray switching operation remains the same no matter which tray becomes the starting tray.

Next, the stapling operation of the sheet accumulation apparatus 1 will be described. To begin with, when in a stapling-sorting mode in which produced copies are stapled, the sheets are not accumulated directly into the trays 23, 24 or 25, and instead, they are first accumulated into the stapling tray 38 shown in FIG. 2. As a stapling-sorting mode is selected by the user, the sheet accumulation apparatus 1 operates as will be described next with reference to FIGS. 17–20.

As a stapling-sorting mode is selected by the user, the oscillation guide 31 is moved upward by an unillustrated driving power source, and is positioned to widen the discharge opening as illustrated in FIG. 16. In other words, the discharge roller 32 and the movable discharge roller 33 become separated from each other. When the sheet accumulation apparatus 1 is in this state, the sheets discharged from the copying machine main assembly 100, that is, the image forming section, are sent through the first conveyance path 6, and are relayed to the first discharge roller 17 and the pressing roller 18. Then, the sheets discharged by the first discharge roller 17 and the pressure roller 18 are accumulate in the stapling tray 38 since the oscillation guide 31 is up. At this point of time, the tray 24 is positioned higher than when the sheet accumulation apparatus 1 is in a non-stapling mode, and supports the leading end of a sheet to assist the sheet in moving in the upstream direction, that is, the direction opposite to the sheet discharge direction, as shown in FIG. 17.

Figure 17:
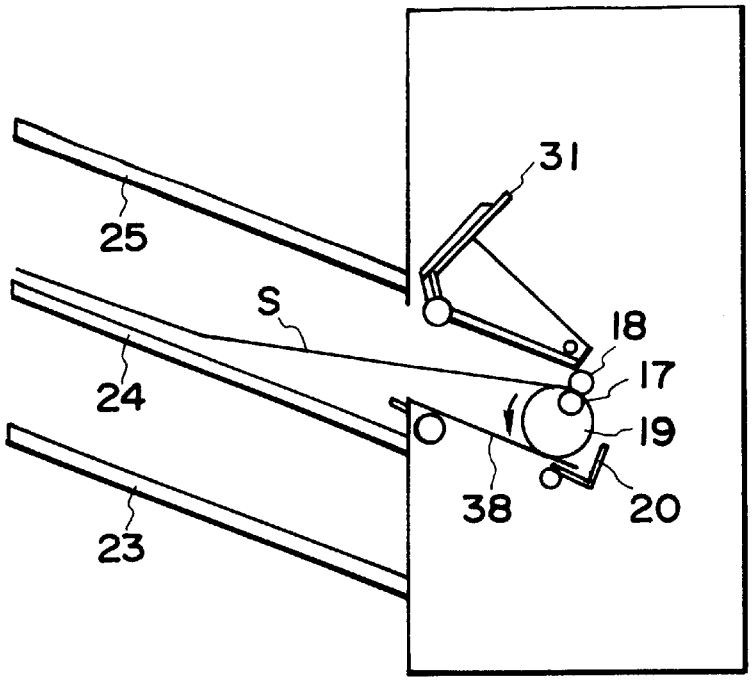
FIG. 17 is a schematic sectional view of the sheet accumulation apparatus, depicting how a sheet is discharged into the second tray from the top, and the stapling tray which is a first tray.

Also referring to FIG. 17, the sheet discharged onto the top surface of the stapling tray 38 is not only assisted in sliding down on the stapling tray 38 in the upstream direction due to its own weight, by the inclination of the stapling tray 38 and the raised sheet landing point in the tray 24, but also is nudged in the upstream direction of the stapling tray 38 by the discharge-jog belt 19 being rotated in the direction of an arrow mark in synchronism with the first discharge roller 17. As a result, the sheet hits the trailing end regulating member 20, to be jogged in the sheet discharge direction. As for the widthwise sheet abutting, that is, the sheet abutting in the direction perpendicular to the sheet discharge direction, it is carried out by the widthwise sheet shifting guide 21 illustrated in FIGS. 3 and 4. More specifically, the widthwise sheet shifting guide 21 is activated a predetermined time after the sheet deposited in the stapling tray 38 hits the trailing and regulating member 20. It is moved in the rear to front direction of FIG. 2 by a predetermined distance. With this movement of the widthwise sheet shifting guide 21, and the presence of the abutting reference plate 63 or sheet regulating fixed member 64, the sheet is jogged in the width direction.

Figure 18:
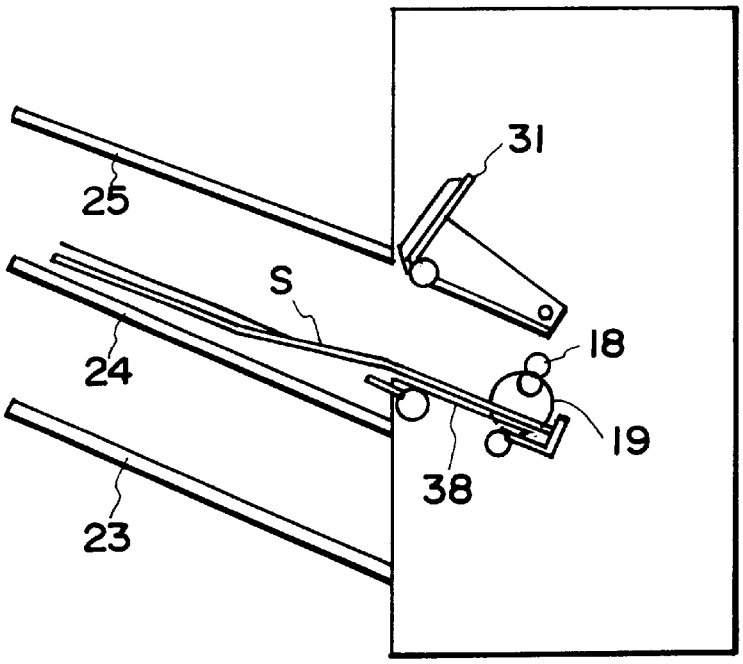
FIG. 18 is a schematic sectional view of the sheet accumulation apparatus, depicting the user selected number of sheets which have been sorted and accumulated into the stapling tray.
Figure 19:
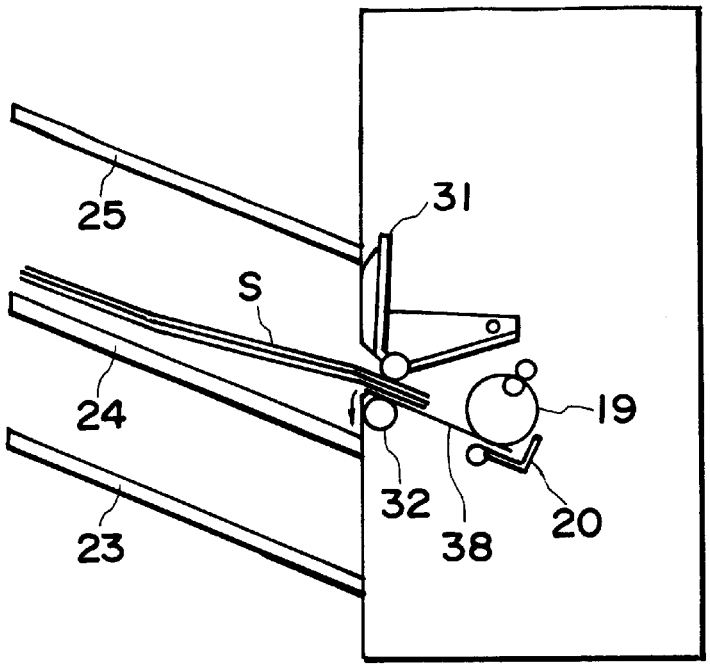
FIG. 19 is a schematic sectional view of the sheet accumulation apparatus in which a stapled sheet set is being discharged.
Figure 20:
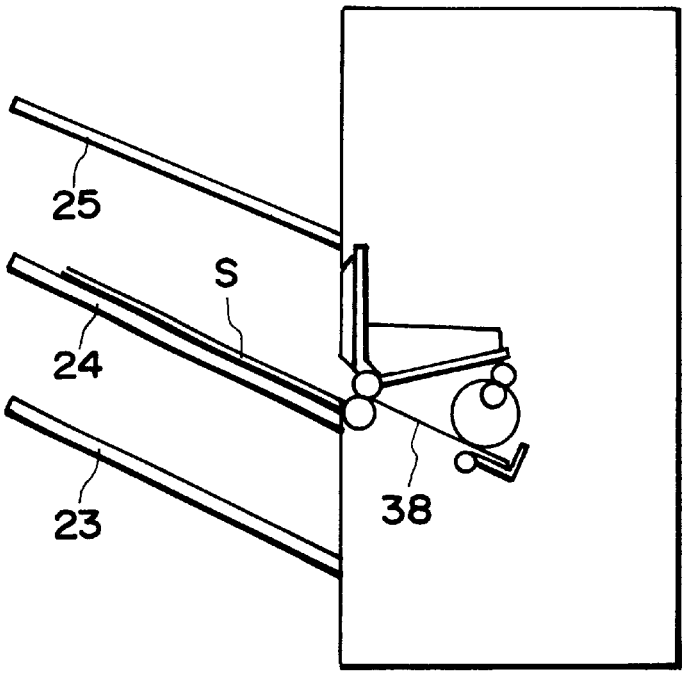
FIG. 20 is a schematic sectional view of the sheet accumulation apparatus in which the stapled sheet set has been discharged.

The above operation is repeated for the second sheet and the following sheets until all the sheets, the number of which is set by the user, are accumulated in the stapling tray 38. Referring to FIG. 18, as the user selected number of sheets are accumulated and aligned in the stapling tray 38, the stapler 22 is activated to staple the sheets, on the spots chosen by the user (FIG. 3). After stapling, the oscillation guide 31 is lowered, and as the discharged roller 32 is rotated in the direction of an arrow mark in FIG. 19, a set of sheets accumulated on the stapling tray 38 and stapled thereon is discharged into the tray 24 (FIG. 20).

If the discharge opening is left exposed by the oscillation guide 31, the sheets accumulated in the trays are liable to slide upstream back into the stapling tray 38 when sheets are selectively discharged into the trays 23, 24 and 25. However, the structure in this embodiment is such that the trays 23, 24 and 25 become movable only after the oscillation guide 31 and stopper 30 are positioned to cover the discharge opening, and the roller 34 is rotated. With the provision of the above structure, a sheet is allowed to move across the discharge opening of the stapling tray 38 without sliding into the discharge opening. Therefore, it is possible to move the trays 23, 24 and 25 while the accumulated sheets are still in the trays, and such capability makes it possible to take full advantage of the capability of the image forming apparatus 500 comprising the interface 501.

Figure 21:
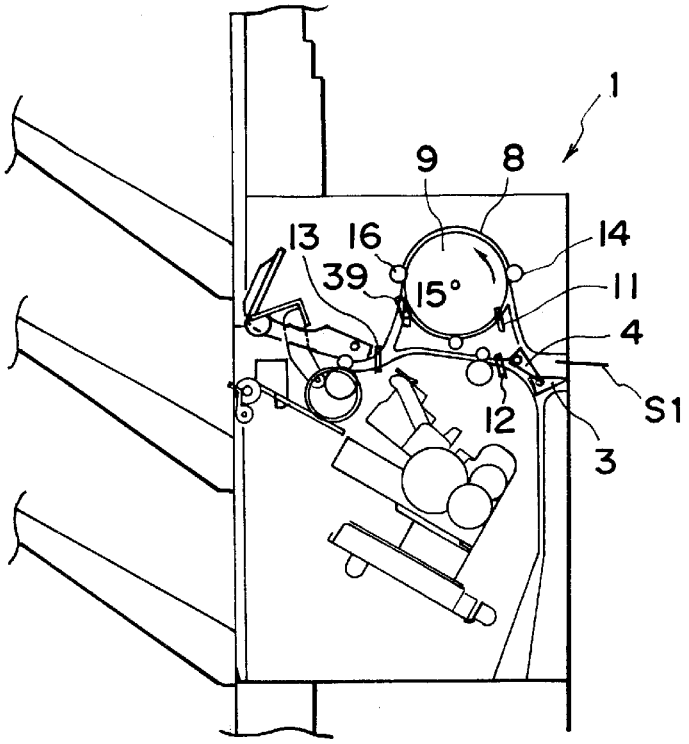
FIG. 21 is a schematic sectional view of the sheet accumulation apparatus into which a sheet has just begun to enter.
Figure 22:
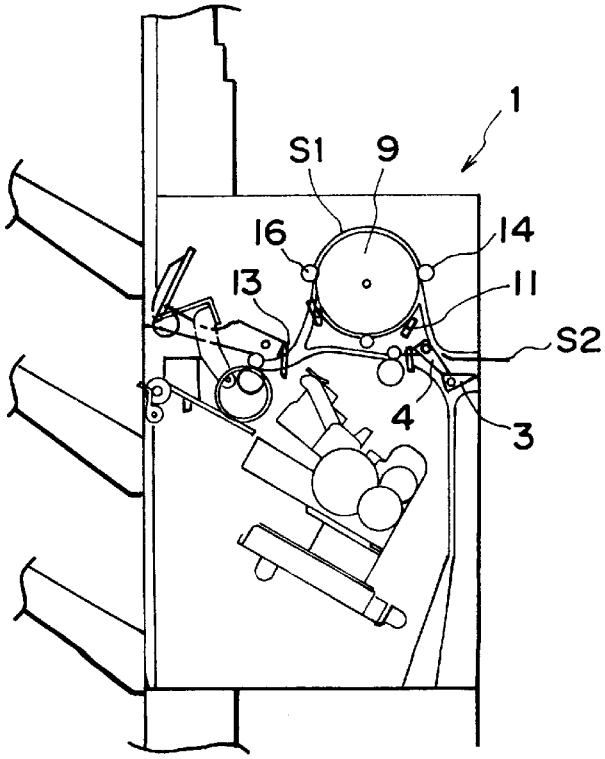
FIG. 22 is a schematic sectional view of the sheet accumulation apparatus in which the first sheet has been wrapped around a buffer roller.

On the other hand, when the apparatus is in a stapling mode, the first sheet discharged in the following set of sheets is retained in the sheet accumulation apparatus 1, and is discharged together with the second sheet, being laid in layers, since the sheets are continuously discharged from the copying machine main assembly 100. This operation will be described with reference to FIGS. 21–24. FIG. 21 depicts a state of the sheet accumulation apparatus 1 which the sheet S began to enter. The first sheet S1 discharged from the copying machine main assembly 100 is sent to a buffer path 88 by directing downward the upstream side ends of the flappers 3 and 4. The sheet S1 sent to the buffer path 8 is conveyed in the direction of an arrow mark in the drawing, in a manner to be wrapped around the buffer roller 9. At this point of time, the flapper 39 is rotated in a manner to send the sheet S1 toward the roller 15. Then, as soon as the leading end of the sheet S1 is detected by a sensor 11, the buffer roller 9 is stopped in the state as shown in FIG. 22.

Figure 23:
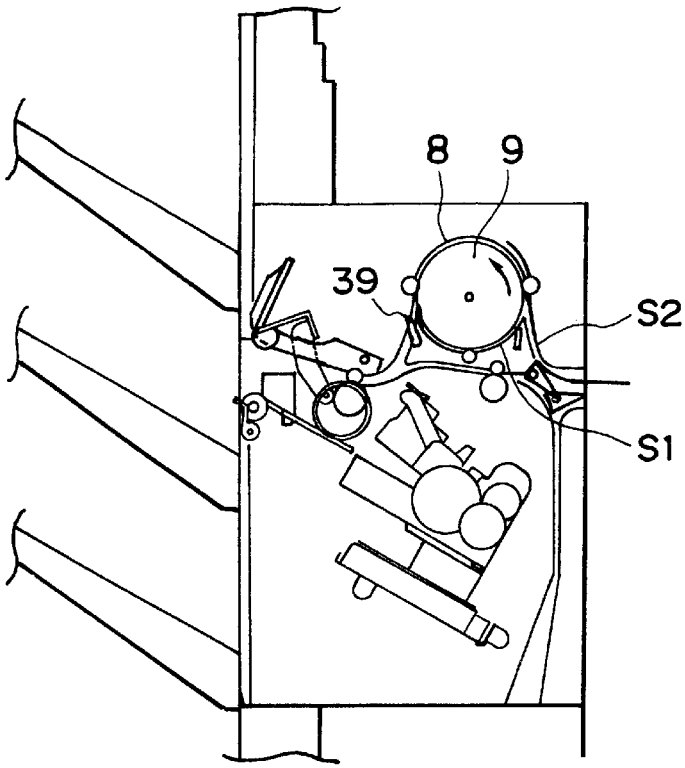
FIG. 23 is a schematic sectional view of the sheet accumulation apparatus in which the first and second sheets S1 and S2 are being conveyed in layers.
Figure 24:
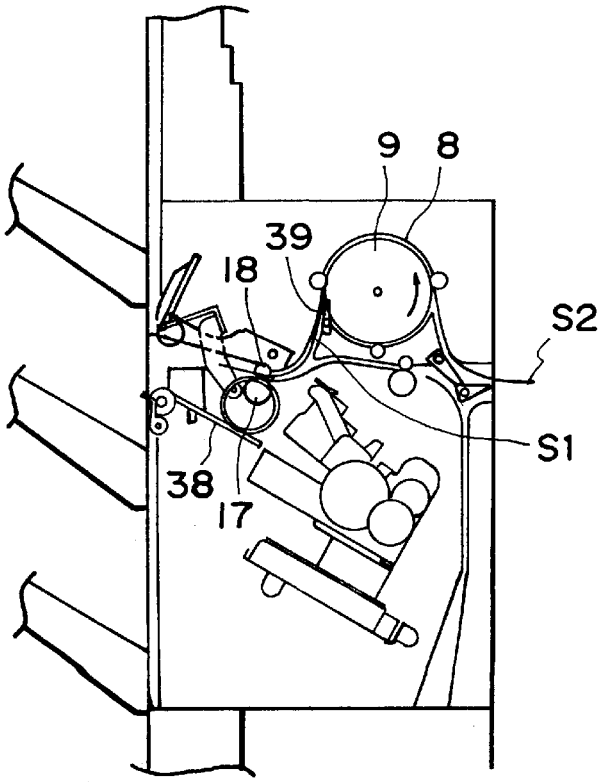
FIG. 24 is a schematic sectional view of the sheet accumulation apparatus in which two sheets are being discharged in layers.

Then, as the second sheet S2 enters the sheet accumulation apparatus 1, the buffer roller 9 is caused to rotate again, conveying the first and second sheets S1 and S2 in layers as shown in FIG. 23. Next, as the trailing end of the first sheet S1 passes the location of the flapper 39, the flapper 39 is rotated in a manner to direct the sheet S toward the discharge rollers 17 and 18. Then, two sheets are discharged, together in layers, into the stapling tray 38. This operation is carried out to prevent the sheet S from being discharged by the discharge roller 17 and 18 while the stapler is stapling. In other words, a stapling operation can be carried out without temporarily holding the operation of the copying machine main assembly 100. It is also possible to wrap the third sheet, the fourth sheet, and so on, around the buffer roller 9 to earn more time for the stapling operation.

Figure 14:
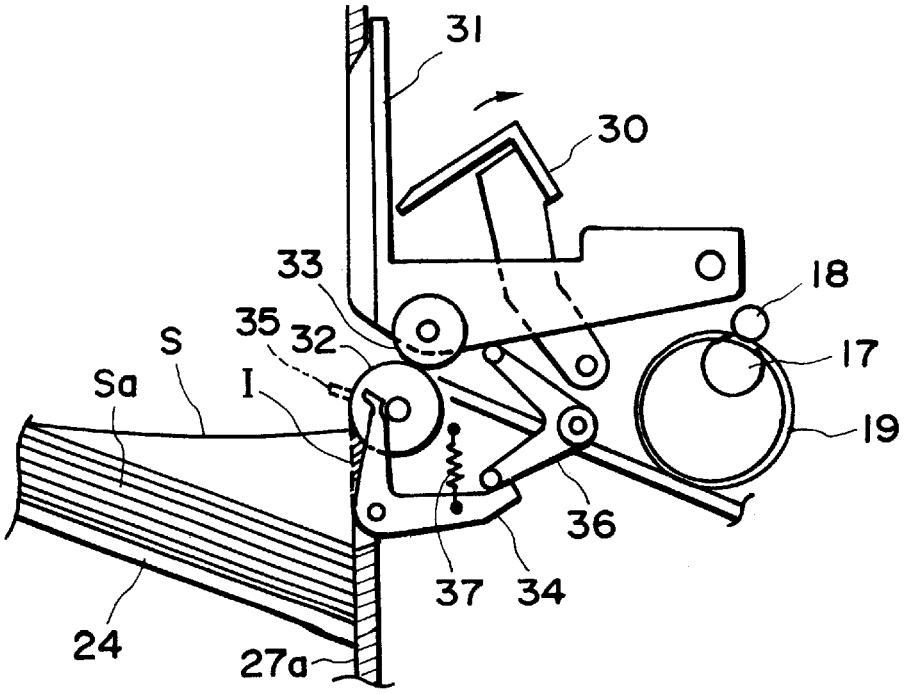
FIG. 14 is an enlarged sectional view of the same, depicting the state of a roller guide at the first position.

The above operation is repeated to produce multiple stapled copy sets Sa. Referring to FIGS. 14 and 16, when the copy sets Sa which are excessively bent or bulky are accumulated in the tray 24, the topmost sheet S of the topmost copy set Sa which has been already accumulated in the tray 24 is liable to come above the point G. If this occurs, the following copy set Sa is liable to hang up as it is discharged, causing thereby a jam, or is liable to increase the load against the abutting movement of the widthwise sheet shifting guide 21, impeding thereby the abutting performance of the widthwise sheet shifting guide 21. However, in this embodiment, when the sheet set Sa is discharged, the roller guide 34 is at the second position, and therefore, the engagement claw 35 of the roller guide 34 is projecting into the space above the tray 24, being enabled to press down the trailing end of the sheet S. Therefore, occurrence of a jam or the like can be prevented.

Figure 26:
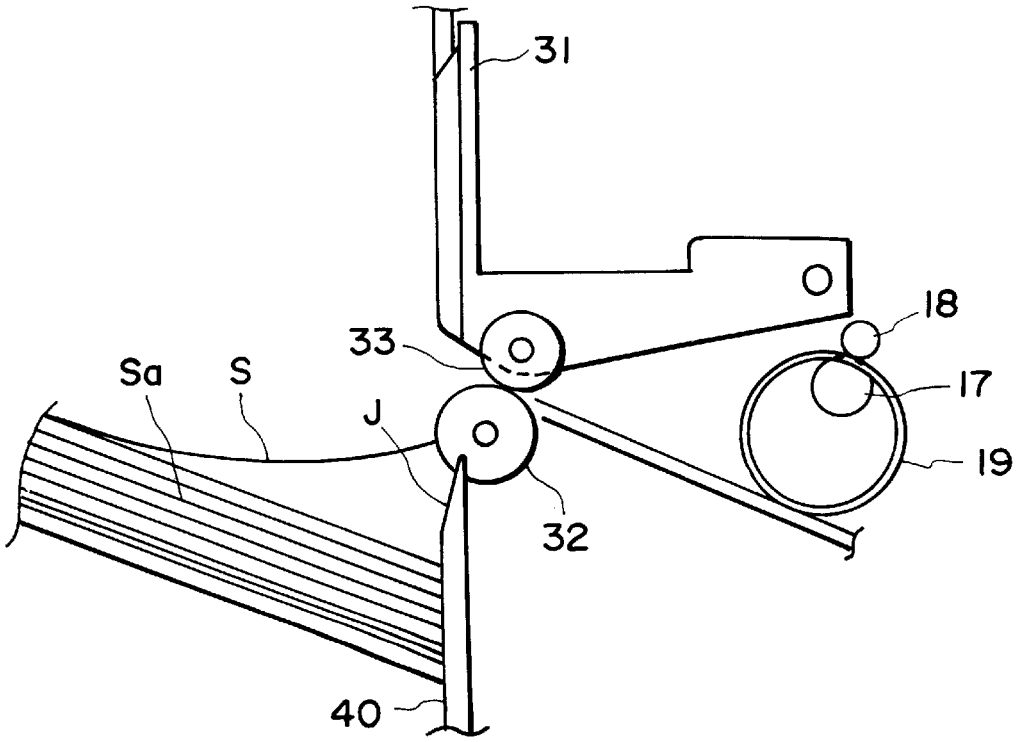
FIG. 26 is an enlarged sectional view of the discharge roller and its adjacencies, depicting a sheet which is sagging with its trailing end hanging up on the discharge roller.

In other words, in this embodiment, normally, when sheets are discharged, the roller guide 34 is placed at the first position to create the recess I (FIG. 14); therefore, sheets can be smoothly discharged. Further when the sheet accumulation apparatus 1 is in a stapling mode, the roller guide 34 is placed at the second position (FIG. 16) to form a temporary wall which is level with the slotted bottom guide 27*a* and temporarily abolishes the recess I, and also to cause the engagement claw 35 to protrude into the space above a pertinent tray so that it becomes possible to avoid occurrence of such a situation that a sheet S discharged into the tray hangs up on the discharge roller 32 as shown in FIG. 26.

Next, an operation in which multiple sheet sets which are not stapled are sorted and accumulated into the trays 23, 24 and 25 will be described. The first set of sheets are accumulated in the stapling tray 38, and are transferred onto the tray 24, for example. Next, a controlling means CPU provided in the image forming apparatus 500 controls the stepping motor 63*b* so that the abutting reference plate 63 is retracted to the second position, that is, the location below the sheet accumulation surface of the stapling tray (abutting tray) 38. Then, the first sheet for the following sheet set (bottommost sheet of the following sheet set) is conveyed onto the stapling tray 38, and is jogged against the training end regulating member 20 by the discharge roller 32 and discharge-jog belt 19, which are being rotated in reverse. Then, the control means CPU controls the motor 65 for driving the widthwise sheet shifting guide 21, in such a manner that the sheet is butted against the sheet regulating fixed member 64. This sheet is conveyed into the tray 24 by the discharge roller 32 which, at this moment, is being controlled by the controlling means in a manner to rotate forward, and the movable discharge roller 33 which has been lowered to make it work in coordination with the discharge roller 32. At this point of time, the first sheet set having been jogged against the abutting reference plate 63 and the first sheet of the following sheet set, which has been jogged against the sheet regulating fixed member 64 are displaced from each other by a distance equal to the distance between the abutting reference plate 63 and the sheet regulating fixed member 64, in the direction perpendicular to the sheet conveyance direction.

Next, the abutting reference plate 63 is returned by the stepping motor 63 to the first position, that is, the location above the sheet accumulation surface of the stapling tray 38, as illustrated by a solid line in FIG. 5. Then, the second sheet and the sheets thereafter of the following sheet set are conveyed onto the stapling tray 38, are abutted to or jogged against the trailing end regulating member 20 by the discharge-jog belt 19, and are jogged against the returned abutting reference plate 63 by the widthwise sheet shifting guide 21. Finally, a sheet set made up of the second sheet and the sheet thereafter of the following sheet set is conveyed onto the tray 24 from the tray 38.

As the above operation is repeated, the bottommost sheet of the following sheet set sticks out to indicates the border between the preceding sheet set and the following sheet set. Therefore, even when multiple sheet sets are conveyed into a single tray 24 (or 23 or 25) and accumulated therein, the accumulated sheet sets do not mix, making the subsequent sorting step easier and more efficient. In this embodiment, the first (bottommost) sheet of a sheet set is displaced, but the last (topmost) sheet of a sheet set may be displaced to obtain the same effect.

While the invention has been described with reference to the structure disclosed herein, it is not confined to the details set forth, and this application is intended to cover such modifications or changes as may come within the purposes of the improvements or the scope of the following claims.

What is claimed is:

1. A sheet stacking apparatus comprising:

sheet discharging means for discharging sheets;

a stacking tray for stacking the sheets;

a retaining tray for retaining one sheet discharging by said discharging means;

shifting means for shifting, in a direction crossing with a direction of the discharging of the sheets, so as to be projected beyond the sheets stacked on said stacking tray, the one sheet on said retaining tray; and feeding means for feeding the one sheet to said stacking tray;

whereby the stacked sheets are grouped with the sheet shifted by said shifting means by alternately repeating stacking of sheets and shifting and feeding of one sheet.

2. An apparatus according to claim 1, wherein said stacking tray is disposed downstream of said retaining tray in the discharging direction, and said discharging means first discharges the sheet to said retaining tray, and said feeding means feeds the sheet to said stacking tray.

3. An apparatus according to claim 2, wherein the sheets on said retaining tray is aligned to alignment reference means for aligning the sheets provided in a direction crossing with the discharging direction.

4. An apparatus according to claim 3, wherein said shifting means also functions as means for effecting the alignment, and a degree of shifting thereby is different between an alignment operation and a shifting operation.

5. An apparatus according to claim 4, further comprising shift reference means for the shifting operation, provided at a position different from that of said alignment reference means.

6. An apparatus according to claim 5, wherein said alignment reference means is retractable upon the shifting operation, and the sheet shifted by said shifting means reaches the shift reference means.

7. An image forming apparatus comprising:

image forming means;

sheet feeding means for feeding a sheet on which an image has been formed by said image forming means, to the sheet stacking apparatus defined in any one of claims 1–6.

8. A sheet stacking apparatus comprising:

sheet discharging means for discharging sheets;

a first tray for stacking the sheets discharged by said discharging means;

aligning means for moving the sheets supported on said first tray in a direction crossing with a direction of discharging of the sheets, to align the sheets;

first driving means for driving said aligning means;

a first sheet regulating member for regulating the sheets moved in the direction crossing with the discharging direction by said aligning means;

second driving means for retracting said first sheet regulating member from said first tray;

a second sheet regulating member disposed more remote from said aligning means than said first sheet regulating member and for regulating the sheets in the direction crossing with the discharging direction by said aligning means; and moving means for moving the sheets supported on said first tray to a second tray adjacent the first tray.

9. An apparatus according to claim 8, wherein said first tray includes a trailing edge regulating member for regulating trailing edges of the sheets, and a discharge aligning belt for abutting the trailing edges to said trailing edge regulating member.

10. An apparatus according to claim 8, wherein said moving means includes a substantially vertically movable discharging roller, and a discharging roller rotatable in forward and backward direction.

11. A sheet stacking apparatus comprising:

sheet discharging means for discharging sheets;

a first tray for stacking the sheets discharged by said discharging means;

aligning means for moving the sheets supported on said first tray in a direction crossing with a direction of discharging of the sheets, to align the sheets;

first driving means for driving said aligning means;

a first sheet regulating member for regulating the sheets moved in the direction crossing with the discharging direction by said aligning means;

second driving means for retracting said first sheet regulating member from said first tray;

a second sheet regulating member disposed more remote from said aligning means than said first sheet regulating member and for regulating the sheets in the direction crossing with the discharging direction by said aligning means;

moving means for moving the sheets supported on said first tray to a second tray adjacent said first tray; and control means for controlling said second driving means to retract said first sheet regulating member and for controlling said first driving means to align a first sheet of a set of the sheets by abutting it to said second sheet regulating member.

12. An apparatus according to claim 11, wherein said control means controls said second driving means so as to reset said first sheet regulating member to an upper surface of said first tray, and controls said first driving means so as to abut second and subsequent sheets of the set of the sheets to said first regulating member.

13. A sheet stacking apparatus comprising:

sheet discharging means for discharging sheets;

a first tray for stacking the sheets discharged by said discharging means;

aligning means for moving the sheets supported on said first tray in a direction crossing with a direction of discharging of the sheets, to align the sheets;

first driving means for driving said aligning means;

a first sheet regulating member for regulating the sheets moved in the direction crossing with the discharging direction by said aligning means;

second driving means for retracting said first sheet regulating member from said first tray;

a second sheet regulating member disposed more remote from said aligning means than said first sheet regulating member and for regulating the sheets in the direction crossing with the discharging direction by said aligning means;

moving means for moving the sheets supported on said first tray to a second tray adjacent said first tray; and control means for controlling said second driving means to retract said first sheet regulating member and for controlling said first driving means to align a last one sheet of the set of the sheets by abutting it to said second sheet regulating member.

14. An apparatus according to claim 13, wherein said control means controls said second driving means so as to reset said first sheet regulating member to an upper surface of said first tray, and controls said first driving means so as to abut first to last-but-one sheets of the set of the sheets to said first regulating member.

15. A sheet stacking apparatus comprising:

sheet discharging means for discharging sheets;

an alignment tray for stacking the sheets discharged by said discharging means in an aligned state;

aligning means for aligning the sheets on said alignment tray by moving them in a direction crossing with a sheet discharging direction;

a sheet regulating member disposed opposed to said aligning means; and a stacking tray for receiving the sheets on said alignment tray;

wherein said sheet regulating member is movable between a first position for receiving the sheets moved by said aligning means and a second position retracted from said first position to increase a movement distance through which the sheets are moved from said first position in the direction crossing with said discharging direction; and wherein said alignment tray is provided with a sheet regulation fixed member at a position spaced from said sheet regulating member in the aligning direction away from said aligning means by a predetermined amount.

16. An apparatus according to claim 15, wherein there are provided a plurality of stacking trays, which are movable substantially vertically.

17. An apparatus according to claim 16, wherein said stacking trays are for a printing function, facsimile function and copying function, respectively.

18. An image forming apparatus comprising:

image forming means;

sheet feeding means for feeding a sheet on which an image has been formed by said image forming means, to the sheet stacking apparatus defined in any one of claim 8–17.

19. A sheet stacking apparatus comprising:

sheet discharging means;

shifting means for shifting a sheet in a direction crossing with a sheet discharging direction on a stacking tray; and control means for controlling said shifting means to cause a first or last sheet of a set of sheets discharged by said sheet discharging means to be stacked on said stacking tray with a shifted state, whereby a plurality of sets of sheets are grouped by the shifted sheet, wherein said tray includes first and second trays, and n−1 sheet of a set of n sheets are stacked on the first tray, and then, are fed as a set of sheets to the second tray, and a rested one sheet of the set of n sheets is stacked on the first tray, and then, is subjected to a shifting operation of said shifting means, and then, is fed to the second tray, wherein a degree of shift is enough to project the one sheet for grouping.

20. An apparatus according to claim 19, wherein said sheet discharging means includes a pair of rotatable members which are contactable and disengageable relative to each other, wherein when the rotatable members are disengaged from each other, the sheet is received by the first tray, and when the rotatable members are contacted to each other, the sheet is received by the second tray.

21. An apparatus according to claim 20, wherein the second tray is disposed downstream of the first tray and is substantially vertically movable, and the pair of rotatable members is disposed downstream of the first tray, wherein upstream of the pair of the rotatable members, a pair of feeding rotatable members is provided.

22. An apparatus according to claim 19, wherein the n−1 sheets are aligned in a direction of the shifting on the first tray, and the degree of shift is different from a degree of shift for the alignment.

23. An apparatus according to claim 22, wherein the degree of shift for grouping is larger than that for the alignment.

24. An apparatus according to claim 1, wherein said shifting means shifts a first sheet of a grouped sheets.

25. An apparatus according to claim 1, wherein said shifting means shifts a last sheet of a grouped sheets.

26. An apparatus according to claim 1, wherein said sheet discharging means includes a pair of rotatable members which are contactable and disengageable relative to each other, wherein when the rotatable members are disengaged form each other, the sheet is received by the retaining tray, and when the rotatable members are contacted to each other, the sheet is received by the stacking tray.

27. An apparatus according to claim 26, wherein the stacking tray is disposed downstream of the retaining tray and is substantially vertically movable, and the pair of rotatable members is disposed downstream of the retaining tray, wherein upstream of the pair of the rotatable members, a pair of feeding rotatable members is provided.

28. An apparatus according to claim 19, wherein said second tray is disposed downstream of said first tray in the discharging direction, and said discharging means first discharges the sheet to said first tray, and said feeding means feeds the sheet to said second tray.

29. An apparatus according to claim 28, wherein the sheets on said first tray is aligned to alignment reference means for aligning the sheets provided in a direction crossing with the discharging direction.

30. An apparatus according to claim 29, wherein said shifting means also functions as means for effecting the alignment, and a degree of shifting thereby is different between an alignment operation and a shifting operation.

31. An apparatus according to claim 30, further comprising shift reference means for shifting operation, provided at a position different from that of said alignment reference means.

* * * * *

UNITED STATES PATENT AND TRADEMARK OFFICE

CERTIFICATE OF CORRECTION

PATENT NO. : 6,179,287 B1
DATED : January 30, 2001
INVENTOR(S) : Tomoyuki Watanabe et al.

It is certified that error appears in the above-identified patent and that said Letters Patent is hereby corrected as shown below:

Column 3,
Line 57, "object," should read -- objects, --.

Column 5,
Line 31, "an" should read -- a --.
Line 55, "forward," should read -- downward, --.

Column 6,
Line 5, "apart" should read -- a part --.
Line 8, "jug-discharge" should read -- jog-discharge --.
Line 15, "a" should read -- an --.
Line 46, "rang" should read -- range --.

Column 7,
Line 50, "conveyor" should read -- conveyer --.

Column 8,
Line 21, "deposed" should read -- disposed --.

Column 11,
Line 32, "was" should read -- way --.

Column 12,
Line 30, "till" should read -- still --.

UNITED STATES PATENT AND TRADEMARK OFFICE

CERTIFICATE OF CORRECTION

PATENT NO. : 6,179,287 B1
DATED : January 30, 2001
INVENTOR(S) : Tomoyuki Watanabe et al.

It is certified that error appears in the above-identified patent and that said Letters Patent is hereby corrected as shown below:

Column 17,
Line 6, "indicates" should read -- indicate --.
Line 42, "is" should read -- are --.

Column 19,
Line 59, "claim" should read -- claims --.

Column 20,
Line 40, "form" should read -- from --.
Line 55, "is" should read -- are --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*